US008770421B2

(12) United States Patent
Hay et al.

(10) Patent No.: US 8,770,421 B2
(45) Date of Patent: Jul. 8, 2014

(54) COLLAPSIBLE REFUSE BIN

(75) Inventors: Henry F. Hay, Calgary (CA); Leslie Kirby, Moon Township, PA (US); Alan Schrob, Aliquippa, PA (US)

(73) Assignee: Nova Chemicals (International) S.A., Pribourg (CH)

( * ) Notice: Subject to any disclaimer, the term of this patent is extended or adjusted under 35 U.S.C. 154(b) by 410 days.

(21) Appl. No.: 12/657,834

(22) Filed: Jan. 28, 2010

(65) Prior Publication Data

US 2011/0180533 A1 Jul. 28, 2011

(51) Int. Cl.
*B65D 6/18* (2006.01)

(52) U.S. Cl.
USPC ..... 220/4.28; 220/6; 220/7

(58) Field of Classification Search
USPC ..... 220/4.28, 6, 4.29, 7, 671, 617, 684, 220/669, 666; 206/600
See application file for complete search history.

(56) References Cited

U.S. PATENT DOCUMENTS

| | | | | |
|---|---|---|---|---|
| 3,374,915 | A * | 3/1968 | Verhein et al. | 220/4.28 |
| 3,796,342 | A | 3/1974 | Sanders et al. | |
| 3,865,269 | A | 2/1975 | Coleman | |
| 3,874,546 | A | 4/1975 | Sanders et al. | |
| 3,985,258 | A | 10/1976 | Quigley et al. | |
| 4,062,467 | A | 12/1977 | Friedrich | |
| 4,158,421 | A * | 6/1979 | Chi | 220/6 |
| 4,624,381 | A | 11/1986 | Friedrich | |
| 4,630,746 | A | 12/1986 | Fortenberry | |
| 4,674,647 | A | 6/1987 | Gyenge et al. | |
| 4,693,386 | A | 9/1987 | Hughes et al. | |
| 4,775,068 | A | 10/1988 | Reiland et al. | |
| 4,782,972 | A * | 11/1988 | Wenkman et al. | 220/4.28 |
| 5,038,953 | A | 8/1991 | Radar | |
| 5,253,763 | A | 10/1993 | Kirkley et al. | |
| 5,351,846 | A * | 10/1994 | Carter | 220/6 |
| 5,361,923 | A | 11/1994 | Knight, IV et al. | |
| 5,419,448 | A | 5/1995 | Watson | |
| 5,474,197 | A | 12/1995 | Hillis et al. | |
| 5,558,241 | A * | 9/1996 | Huffstutler et al. | 220/1.5 |
| 5,669,507 | A * | 9/1997 | Pruitt, Jr. | 206/600 |
| 6,015,056 | A | 1/2000 | Overholt et al. | |
| 6,098,827 | A | 8/2000 | Overholt et al. | |
| 6,182,849 | B1 | 2/2001 | Elstone, Sr. | |
| 6,229,011 | B1 | 5/2001 | Chen et al. | |
| 6,484,898 | B2 | 11/2002 | Hillis et al. | |
| 6,631,821 | B2 | 10/2003 | Vourganas | |
| 6,726,046 | B2 | 4/2004 | Orset | |
| 6,761,277 | B2 * | 7/2004 | Dotan | 220/4.28 |
| 6,863,180 | B2 | 3/2005 | Apps et al. | |
| 6,913,161 | B2 | 7/2005 | Schafer | |

(Continued)

FOREIGN PATENT DOCUMENTS

| | | |
|---|---|---|
| CA | 1065777 | 11/1979 |
| CA | 1159379 | 12/1983 |
| CA | 1333055 | 11/1994 |

*Primary Examiner* — Jeffrey Allen
(74) *Attorney, Agent, or Firm* — Kenneth H. Johnson

(57) ABSTRACT

A collapsible refuse bin which has two ends walls and two side walls atop a base. The end walls, side walls and base are twinned wall plastic components. The side walls are made of two panels which are pivotally attached to one another along vertical axis. The end walls are pivotally attached to the base. The side walls engage a base along a tongue and groove means. Side walls and end walls have mutually engaging edges. Removal of the side walls followed by folding down the end walls converts the refuse bin to a collapsed position.

11 Claims, 29 Drawing Sheets

(56) References Cited

U.S. PATENT DOCUMENTS

| | | | | |
|---|---|---|---|---|
| 7,017,766 | B2 | 3/2006 | Hsu et al. | |
| 7,044,319 | B2 | 5/2006 | Overholt et al. | |
| 7,059,489 | B2 | 6/2006 | Apps et al. | |
| 7,137,522 | B2 | 11/2006 | Dubois | |
| 7,156,249 | B2 | 1/2007 | Heinrichs | |
| 7,175,040 | B2 | 2/2007 | Lorenz et al. | |
| 7,296,704 | B2 * | 11/2007 | Ferrini | 220/1.5 |
| 2003/0150769 | A1 * | 8/2003 | Lau | 206/600 |
| 2004/0232146 | A1 * | 11/2004 | Kessler et al. | 220/6 |
| 2005/0224494 | A1 * | 10/2005 | Heinrichs | 220/4.28 |
| 2008/0169285 | A1 * | 7/2008 | Marazita et al. | 220/7 |
| 2009/0014445 | A1 | 1/2009 | Hay et al. | |
| 2009/0134057 | A1 | 5/2009 | Hidalgo Vargas | |

* cited by examiner

COLLAPSIBLE REFUSE BIN

FIELD OF THE INVENTION

The present invention relates to the area of collapsible containers, more specifically to collapsible plastic containers. Such containers may, for example, be useful for storage purposes or for use as refuse bins.

BACKGROUND OF THE INVENTION

There are numerous examples of collapsible boxes, bins, dumpsters, storage containers and the like available. These structures are commonly made form materials such as cardboard, wood, and metal. Plastic structures are also known and typically comprise injection molded plastic components.

Collapsible containers often have wall components which are pivotally attached to a base or pallet member along a horizontal hinge axis (see for example U.S. Pat. Nos. 3,874,546; 4,062,467; 4,674,647; 4,775,068; 5,419,448; 6,015,056; 6,098,827; 6,863,180; 7,017,766; 7,044,319; 7,059,489; 7,156,249; and CA Pat. No. 1,065,777). The wall components themselves may comprise pivotally attached sections, most typically along a horizontal axis (see for example U.S. Pat. Nos. 3,796,342; 5,038,953; 5,253,763; 6,726,046; 6,913,161; 7,137,522; 7,175,040 and CA Pat No. 1,333,055). By contrast, collapsible containers having a wall component that comprises sections which are pivotally connected along a vertical axis are less common (see for example U.S. Pat. Nos. 3,865,269; 4,630,746; 5,361,923; 6,182,849; 6,229,011). Collapsible containers often have an open top but may also have removable or attached lid components (for examples of containers having a pivotally attached lid see U.S. Pat. No. 4,624,381 and US Pat App. No. 2009/0134057A1).

To impart rigidity and strength to plastic components used in containers, the components are often ribbed or open framework structures, in which flanged sections may be arranged perpendicularly to the vertical or load bearing axis (see U.S. Pat. Nos. 3,985,258; 5,474,197 and 6,484,898).

In contrast, commonly owned US Pat. App. No. US2007000827311, describes the use of twinned wall plastic components to impart high structural strength and rigidity to a collapsible storage container, while at the same time minimizing container weight. The container has an integral roof and end walls which fold inwardly along a horizontal axis and serves as a collapsible storage system. Also present are elongate concave indentations which increase the flexural rigidity of the wall components.

U.S. Pat. No. 6,631,821, describes an open topped knock down bin, which comprises twinned wall (or "double wall") components. The double wall components consist of a base, two ends walls and two side walls and are preferably composed of rotomolded plastic. Although the knock down bin can be disassembled, none of the walls are pivotally attached to the base in such as way as to facilitate rapid collapsing of the bin. Instead, the bin has a network of horizontally and vertically penetrating reinforcing bars to hold the bin corners together and which must be removed prior to deconstructing the bin. Also, the bin does not contain wall components which can be folded back on themselves so as to facilitate storage within the periphery of the base when in a collapsed state. Finally, the bin has vented walls and is not weather proof.

U.S. Pat. No. 4,693,386 and CA Pat. No 1,159,379 each describe a collapsible shipping container made out of twinned wall rotomolded plastic components. In each case, the containers have four side walls, a base and an open top. All side walls are pivotally attached to the base. Neither container includes a wall component having a vertical axis along which two or more wall sections are pivotally joined.

It would be desirable to have an open-topped, collapsible container comprising twinned wall plastic components which are strong and light weight and where the components can be easily and securely stored within the container, when the container is in a collapsed state. Such a container would be particularly useful if it allowed both side and top access while in an erect position.

SUMMARY OF THE INVENTION

The current invention provides a collapsible container with an open top. The container may conveniently serve directly as a refuse bin, or as a container in which packaged garbage can be stored.

In an embodiment, the collapsible container is used as a refuse bin. The collapsible container is weather resistant and/or animal proof when covered with an optional lid.

Provided is a collapsible plastic container that allows side and top access to the interior when in an erect position.

The collapsible container is relatively light weight and is constructed from plastic components. The container has superior weather resistance when compared to containers made from wood or metal or prior art plastic bins or containers. The container may be fitted with an optional lid for further weather proofing or to prevent animals from entering the container.

The invention provides an open-topped, collapsible container comprising twinned wall plastic components which are strong and light weight and where the components can be securely stored when the container is in a collapsed state.

In an embodiment of the invention, the side walls are completely removable, and the end walls are integrally attached to the base by a pivotal attachment means.

In an embodiment the collapsible container has side walls, ends walls and a base. The ends walls are pivotally attached to the base and form mutually engaging edges with the side walls. The side walls engage the base along mutually engaging adjacent edges.

The present invention provides a collapsible container comprising: a base, a pair of integral end walls, and a pair of removable side walls; each of the side walls comprising two side wall panels pivotally attached to one another along a vertical axis; the end walls being pivotally attached to the base; the end walls and the side walls having mutually engaging edges; the side walls engaging the base along reversibly engaging adjacent edges; the end walls and the side walls being a twinned wall structure defined by inner and outer wall members made of plastic.

Provided is a collapsible container comprising: a base, a pair of integral end walls, and a pair of removable side walls; wherein, the end walls are pivotally attached to the base; a lower edge of the side walls reversibly engages a peripheral surface of the base; the end walls and the side walls reversibly engage one another along adjacent edges; the end walls and the side walls are a twinned wall structure defined by inner and outer wall members made of plastic; and each of the side walls comprises two side wall panels pivotally attached to one another along a vertical axis.

In an embodiment, the container has a pair of removable side walls, each of the side walls comprises two side wall panels pivotally attached to one another along a vertical axis; wherein a slide lock is present on one or both of the side walls, the slide lock riding along common upper edges of adjacent side wall panels and having a locked and unlocked position; the locked position preventing the folding of a side wall along the vertical axis; the unlocked position allowing the folding of a side wall along the vertical axis.

In an embodiment of the container, a lower edge of the side walls reversibly engage peripheral surfaces of the base by a tongue and groove means. In another embodiment of the container, the end walls and the side walls reversibly engage one another along adjacent edges by a tongue and groove means.

In another embodiment, the end walls are pivotally attached to end retaining walls extending upwardly from said base.

In an embodiment, the end walls, end retaining walls and the side walls have, along one lateral edge, a corner extension.

In another embodiment the corner extension on the end walls and the end retaining walls reversibly engages an adjacent edge of the side walls by a tongue and groove means, and the corner extension on the side walls reversibly engages an adjacent edge of the end walls by a tongue and groove means.

In an embodiment, a slide lock is present on one or both side walls, wherein the slide lock rides along common upper edges of the side wall panels, and wherein the slide lock prevents the folding of the side walls when in a locked position and allows the folding of the side walls when in an unlocked position.

In an embodiment of the invention, the side walls comprise two side wall panels which are pivotally attached to one another, so as to allow side access to the container without having to remove an entire side wall when the container is in an erected state.

The container may be open topped or fitted with an optional lid which is removable or pivotally attached to a side wall or end wall component. The lid may comprise one or more lid components, which when opened, allow top access to the container, when the container is in an erected state.

In an embodiment of the invention, the collapsible container has two side walls, two end walls and a base, at least one of which is a twin walled plastic component which is optionally rotomolded.

In an embodiment of the invention, the collapsible container has two side walls, two end walls and a base, each of which is a twinned wall plastic component which is optionally rotomolded.

In an embodiment of the invention, at least one of the side walls is composed of two side wall panels. The side wall panels are pivotally attached to one another along a vertical axis by a pivotal attachment means. The attachment means can be any suitable means such as for example a webbing or at least one hinge. The end walls are pivotally attached to the base using any suitable means such as for example, a webbing or at least one hinge. In order to impart structurally rigidity, the container has ends walls and side walls which are plastic components having a twinned wall structure. The twinned wall structure is defined by an inner wall member and an outer wall member.

In an embodiment, the container has a lid which is optionally made of rotomolded plastic and optionally has a twinned wall structure.

In an embodiment of the invention, at least one of the side walls and/or end walls has elongate concave cut outs or indentations. The concave indentations define an internal arch between an inner and outer wall member of a side wall and/or end wall which is a twinned wall plastic component. Optionally kiss offs may be incorporated within or aligned with the concave indentations so as to form points of contact between inner and outer wall members.

In an embodiment of the invention, the collapsible container is fitted with a liner to prevent leakage of waste materials from the container (e.g. liquid waste).

In an embodiment of the invention, the collapsible container is covered by a non-rigid, weather resistant top such as for example a canvass or flexible plastic top.

Containers which comprise combinations of the various features described above are also part of the present invention. For example, embodiments corresponding to the following container options are considered part of the present invention. Option 1: A collapsible container comprising: a base, a pair of integral end walls, and a pair of removable side walls; wherein, said end walls are pivotally attached to said base; a lower edge of said side walls reversibly engages a peripheral surface of said base; said end walls and said side walls reversibly engage one another along adjacent edges; said end walls and said side walls are a twinned wall structure defined by inner and outer wall members made of plastic; and each of said side walls comprises two side wall panels pivotally attached to one another along a vertical axis. Option 2: The container of Option 1, wherein said lower edge of said side walls reversibly engages said peripheral surface of said base by a tongue and groove means. Option 3: The container of Options 1 or 2 wherein said end walls and said side walls reversibly engage one another along adjacent edges by a tongue and groove means. Option 4: The container of Options 1 or 3 wherein said end walls are pivotally attached to end retaining walls extending upwardly from said base. Option 5: The container of Option 4, wherein said end walls, said end retaining walls and said side walls have, along one lateral edge, a corner extension. Option 6: The container of Option 5, wherein said corner extension on said end walls and said end retaining walls reversibly engages an adjacent edge of said side walls by a tongue and groove means, and wherein said corner extension on said side walls reversibly engages an adjacent edge of said end walls by a tongue and groove means. Option 7: The container of Options 1, 2, 3, 4, 5 or 6, wherein a slide lock is present on one or both of said side walls, said slide lock riding along common upper edges of adjacent side wall panels and having a locked and unlocked position; said locked position preventing the folding of a side wall along said vertical axis; said unlocked position allowing the folding of a side wall along said vertical axis. Option 8: The container of Options 1, 2, 3, 4, 5, 6 or 7 wherein at least one of said side walls and said end walls has at least one concave indentation, said concave indentation forming an internal arch between said inner and outer wall members. Option 9: The container of Options 1, 2, 3, 4, 5, 6, 7 or 8 wherein said base has forklift tine pockets. Option 10: The container of Options 1, 2, 3, 4, 5, 6, 7, 8 or 9 additionally comprising a liner. Option 11: The container of Options 1, 2, 3, 4, 5, 6, 7, 8, 9 or 10 additionally comprising a lid. Option 12: The container of Options 1, 2, 3, 4, 5, 6, 7, 8, 9 or 10 additionally comprising a canvass top. Option 13: The container of Options 1, 2, 3, 4, 5, 6, 7, 8, 9, 11, or 12 wherein said ends walls and side walls are held to one another along said adjacent edges with a fastening means. Option 14: The container of Options 1, 2, 3, 4, 5, 6, 7, 8, 9, 10, 11, 12 or 13 wherein said side walls and said end walls are rotomolded plastic components.

DETAILED DESCRIPTION

In the current invention, the use of the terms "end wall" and "side wall" is arbitrary and is used only to distinguish one set of opposing container walls from the other. It will be recognized by a person skilled in the art that the side walls can be designated as the end walls and vice versa and that the side walls can be the same length as the end walls, or they may be longer or shorter than the end walls. However, for a rectangular container, the term "end walls" will be used to describe the relatively short walls, while the term "side walls" will be used to describe the relatively long walls as is conventional in the art.

The terms "engaging", "reversibly engaging" "mating", "engaging edges" "reversibly engaging edges" or "mating edges" includes adjacent surfaces and/or edges having complimentary tongue and groove means, interlocking edges, interlocking offset edges, abutting offset edges and the like, but does not include fully abutting parallel edges and/or surfaces having no overlapping or offset regions (i.e. fully flush surfaces and/or edges).

The term "removable" is meant to encompass container components that are in their entirety removable from the container without an attachment point to any other component of the container. In contrast, the term "integral" is meant to encompass container components that have at least one point of attachment to at least one other component of the container regardless of their orientation or configuration.

The present invention is a collapsible structure or container which may optionally be used as a refuse bin.

Figure 1A:
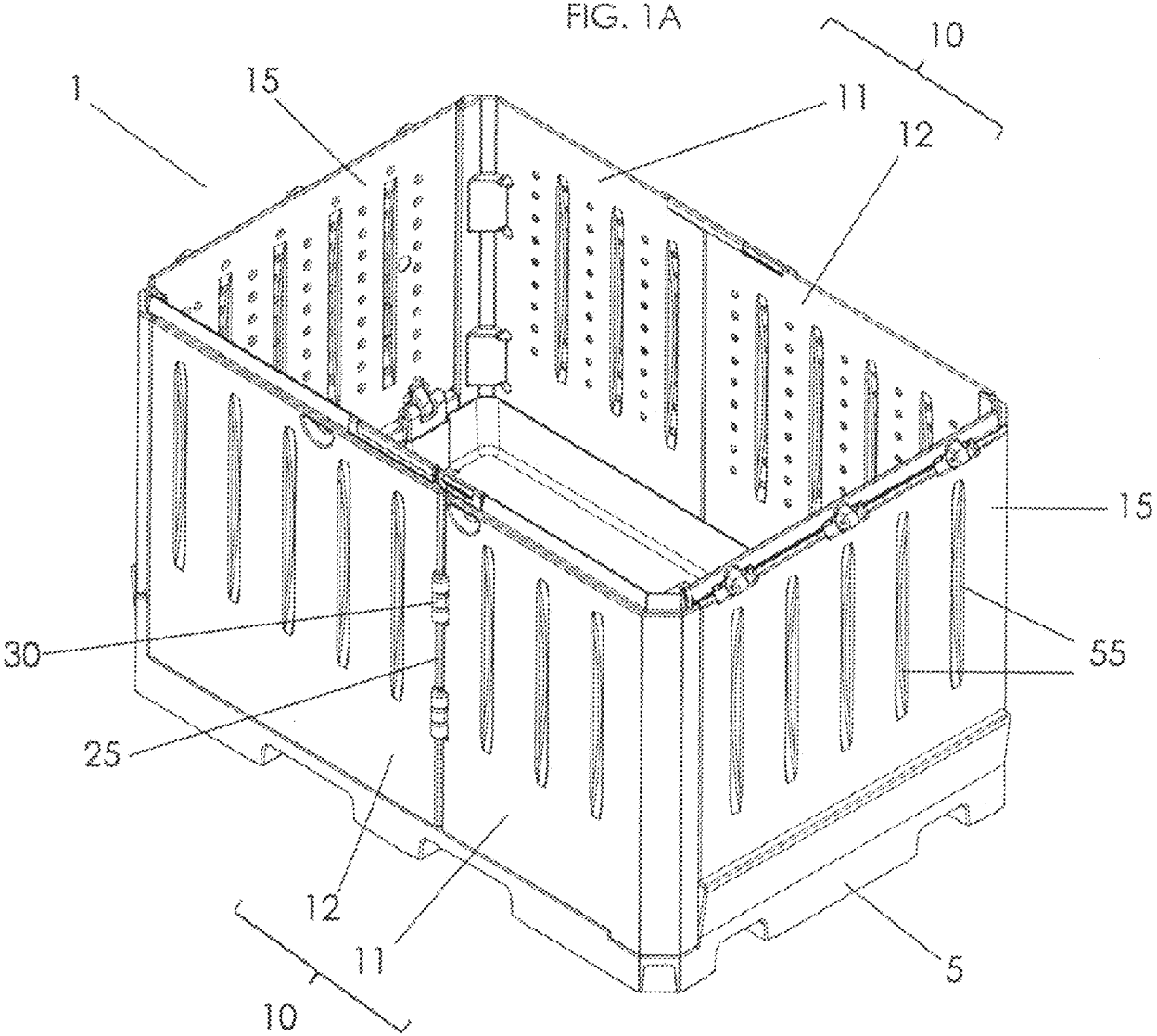
FIG. 1A shows a perspective view of an embodiment of the current invention.
Figure 1B:
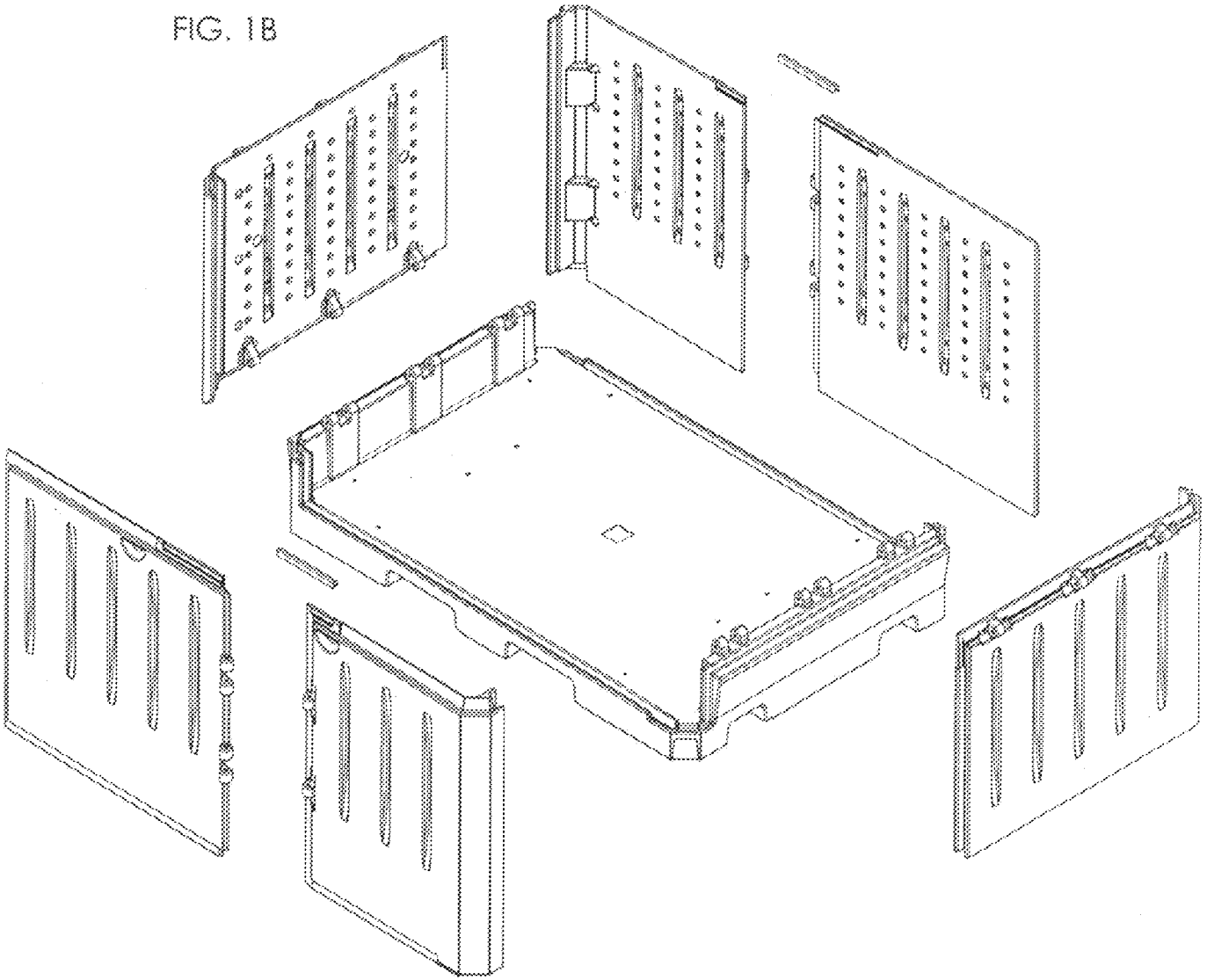
FIG. 1B shows an exploded perspective view of an embodiment of the invention.

With reference to FIGS. 1A and 1B, the container 1, has a base 5, a pair of side walls 10, and a pair of ends walls 15.

In the current invention, at least one of the side walls 10 is composed of two side wall panels 11 and 12. The side wall panels are pivotally attached to one another along a vertical axis 25 by a pivotal attachment means. The attachment means can be any suitable means such but not limited to a plastic webbing or one or more hinges. Use of one or more hinges 30 is preferred. The side wall panels 11 and 12 may be of the same or different size. The size of each panel will depend on the position of the vertical axis 25. With reference to FIGS. 1A, 1C, 2A and 2B, in an embodiment of the invention, the side wall panel 11, will have a smaller horizontal dimension (i.e. width) than the side wall panel 12.

Figure 3A:
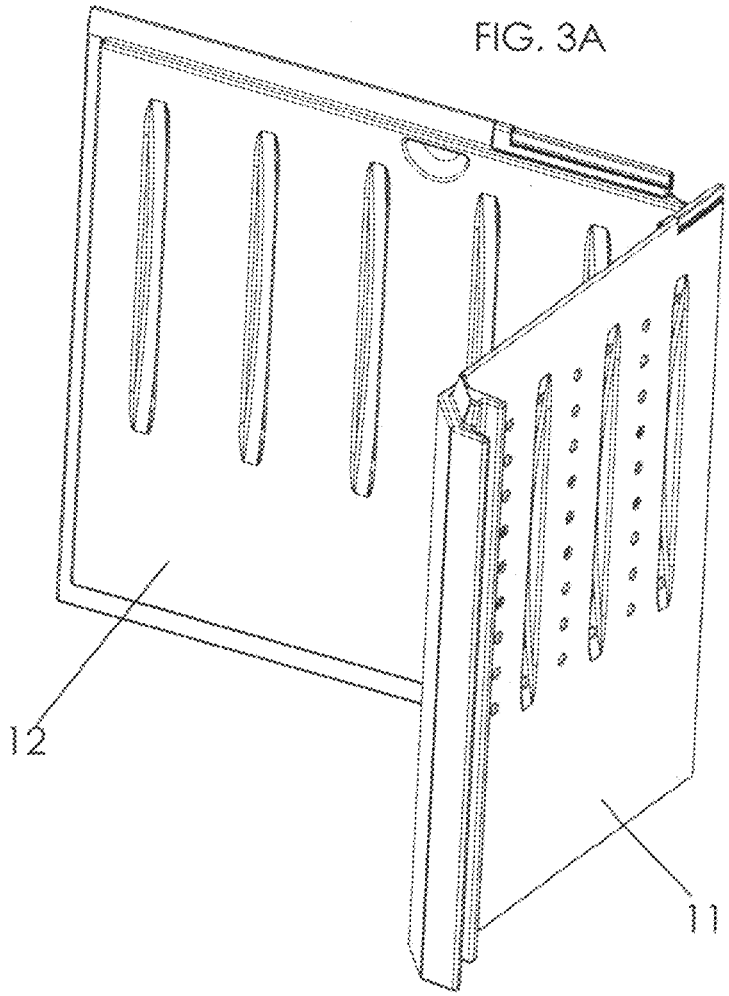
FIG. 3A shows a perspective view of a folded side wall in an embodiment of the invention.

Hinges 30 may be outwardly or inwardly offset and the side wall panels 11 and 12 may have abutting or mating adjacent edges. The use of one or more offset hinge allows the side wall panels to fold in only a single direction. For example, the combination of abutting edges or offset edges and an outwardly offset hinge provides a stop against the outward folding of the side walls proximal to axis 25 (i.e. the panels 11 and 12 may only be folded so that their outer surfaces approach one another as shown in FIG. 3A). Alternatively, the combination of abutting edges or offset edges and an inwardly offset hinge provides a stop against the inward folding of the side walls proximal to axis 25 (i.e. the panels 11 and 12 may only be folded so that their inner surfaces approach one another).

Figure 1C:
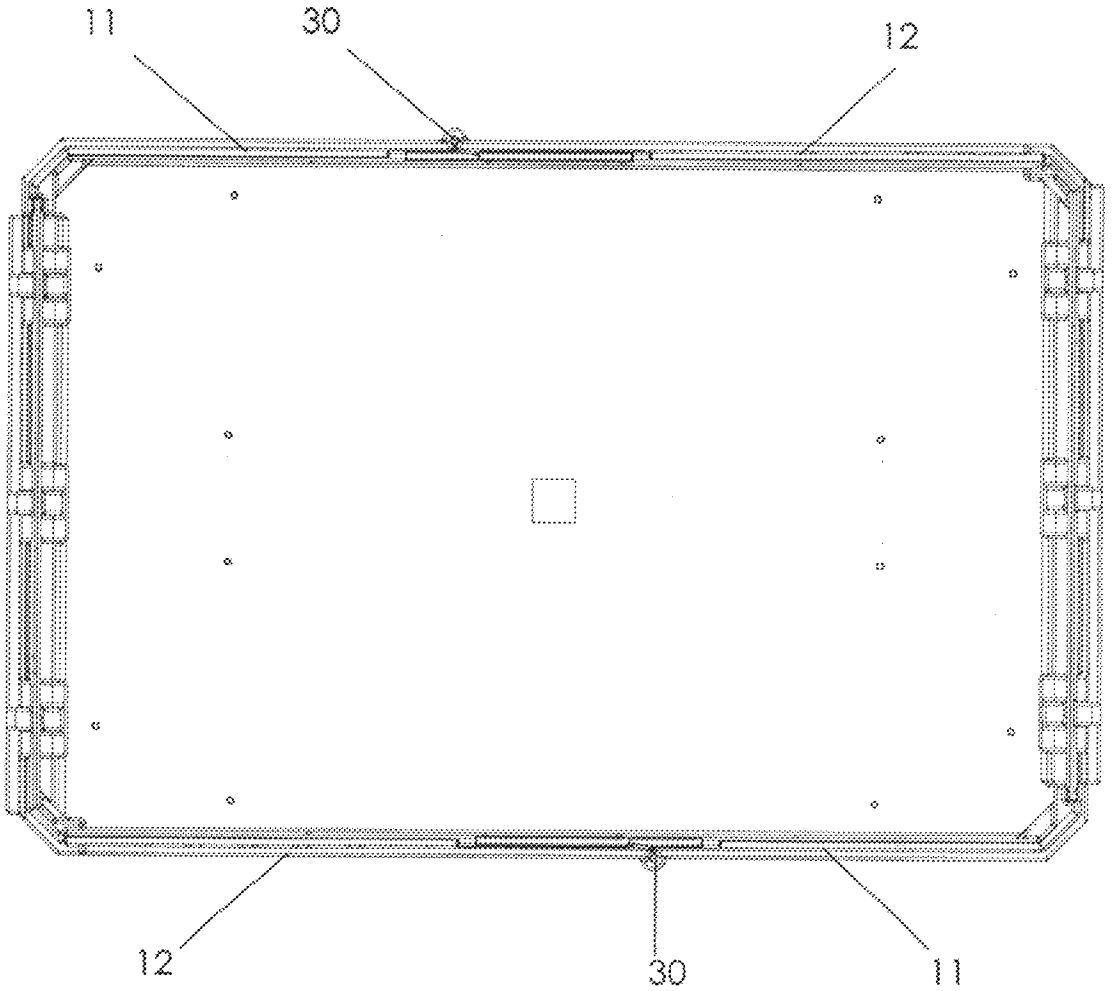
FIG. 1C shows a top plan view of an embodiment of the invention.
Figure 2A:
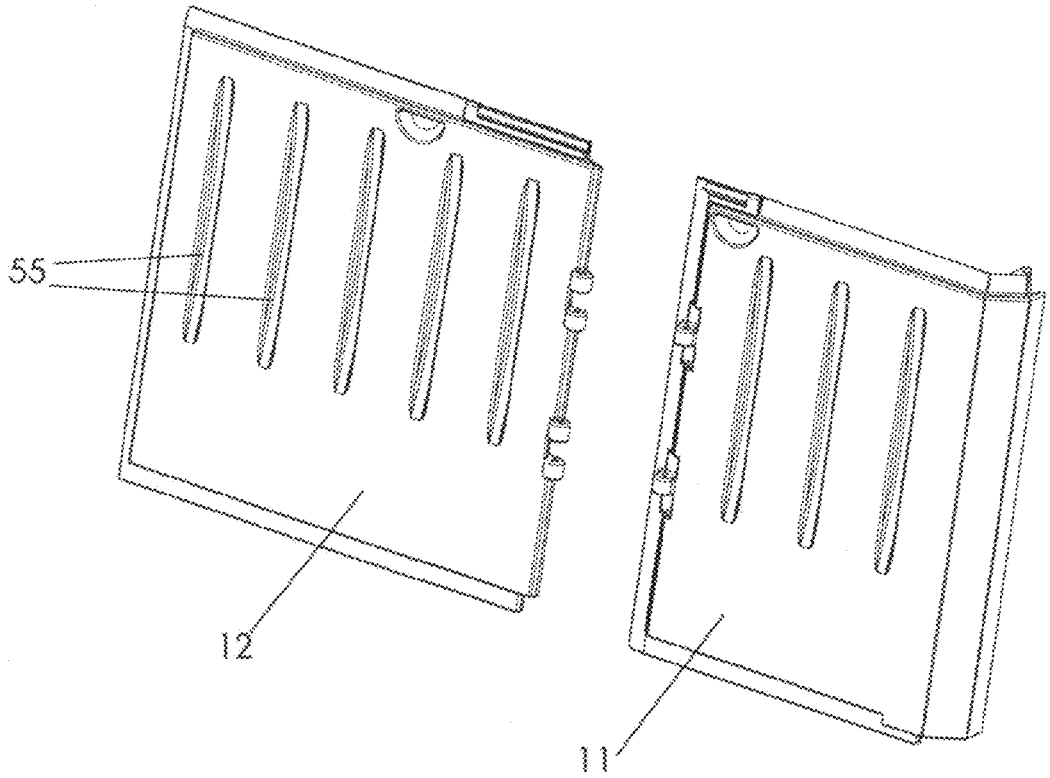
FIG. 2A shows an exploded front perspective view of a first and second side wall panel in an embodiment of the invention.
Figure 2B:
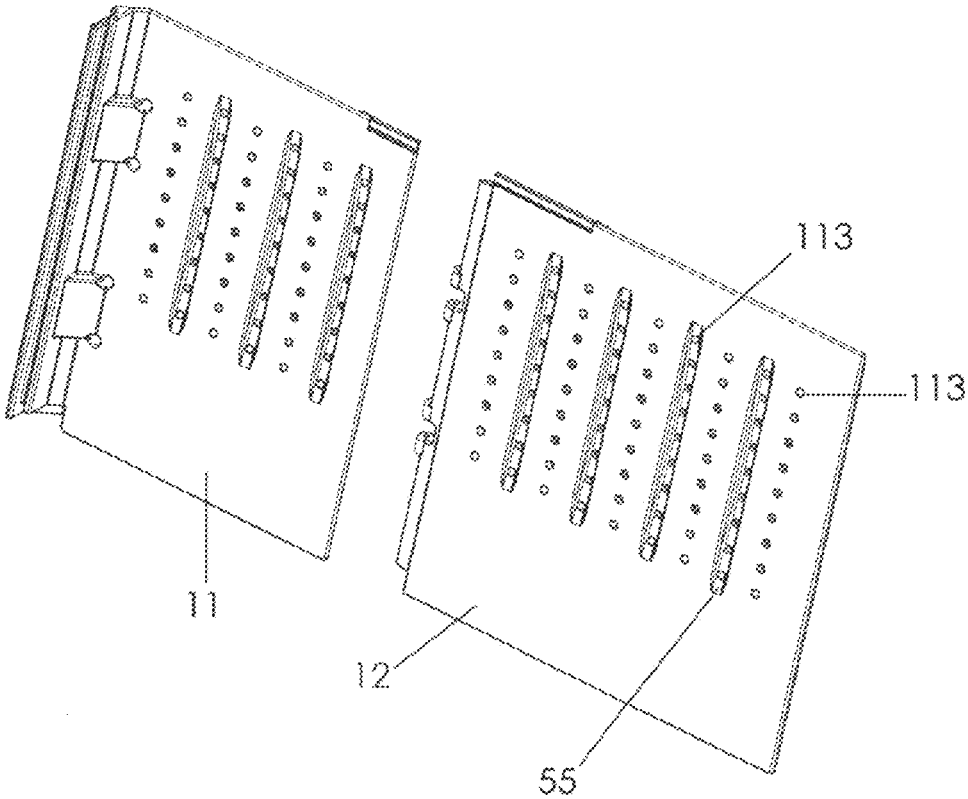
FIG. 2B shows an exploded rear perspective view of a first and second side wall panel in an embodiment of the invention.
Figure 3B:
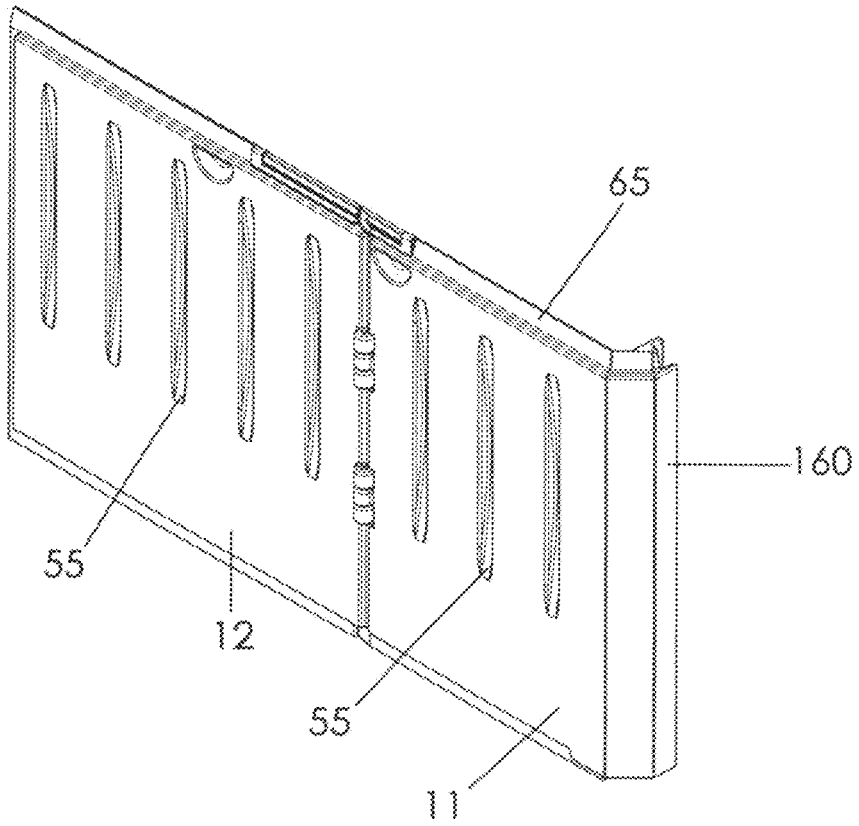
FIG. 3B shows a front perspective view of a side wall in an embodiment of the invention.

In an embodiment of the invention, an outwardly offset pair of edges on a side wall panel (e.g. 12) mates with an inwardly offset pair of edges on an adjacent side wall panel (e.g. 11) when the side wall is fully unfolded, as shown further in FIGS. 1C, 2A and 3B. Also shown in FIG. 1C, are hinges 30 which are outwardly offset. The use of mating offset edges reduces water entry along the vertical axis 25 and provides a stop against the outward folding of the side walls.

In the present invention, each end wall 15 is pivotally attached to the base 5. Any suitable means such as but not limited to a plastic webbing or a hinge can be used. The use of one or more hinges is preferred.

Figure 4:
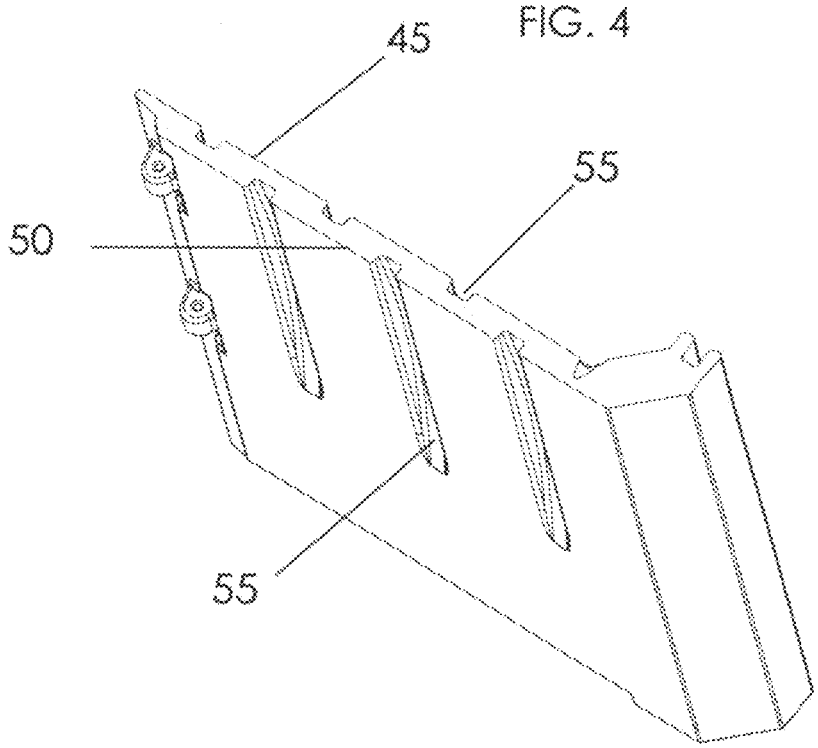
FIG. 4 shows a cross sectional perspective view of a side wall panel in an embodiment of the invention.

In a preferred embodiment the ends walls and the side walls are plastic components having a twinned wall structure defined by an inner wall member 45 and an outer wall member 50. The base may also have a twinned wall structure. The twinned wall structure has a void space between inner and outer wall members 45 and 50 respectively as shown in FIG. 4 for a side wall panel 11. A person skilled in the art will recognize, that similar twinned wall structures having an inner wall member 45 and an outer wall member 50 can be drawn for the side walls, the end walls, and the base (and when present, for an optional lid). The distinction between inner wall member 45 and outer wall member 50 is arbitrary, but for convenience, the inner wall member is the wall member that faces the inside of the container when erected, and the outer wall member is the wall member the faces the outside of the container when erected.

In an embodiment, the end walls, side walls and base are rotomolded plastic parts.

Rotomolding techniques are well known in the art and are particularly well suited to the production of large or hollow plastic parts having complex shapes. The plastic used can be any plastic suitable for rotomolding applications and will preferably have some inherent resiliency to cracking, flexing, stretching and the like. By way of a non-limiting example only, the plastic used may be a thermoplastic such as an ethylene homopolymer or an ethylene/alpha olefin copolymer. In the current invention the term "polyethylene" refers to both a polyethylene homopolymer or copolymer.

In an embodiment of the present invention, each of the base, end walls and side walls are plastic components independently rotomolded from one or more thermoplastic polyolefins, such as but not limited to polyethylene. For example, the base, end walls, side walls and optional roof, may be fabricated from rotational molding methods using polyethylene resins, such as but not limited to one or more SURPASS® polyethylene resins, available from NOVA Chemicals Inc.

With reference to FIGS. 1A, 3B, 3C, 4 and 5, the load bearing capacity of the side walls and the end walls can be increased by incorporating a plurality of concave indentations 55, each indentation forming an internal arch, 60 between inner 45 and outer wall 50 members. As shown in FIGS. 1A, 3B, 3C, 4 and 5 the concave indentations 55 are elongate and are substantially vertical in orientation when the container is erect. The concave indentations can face inward as when in the outer wall member, or they can face outward as when in the inner wall member. A combination of inward and outward facing concave depressions is also contemplated by the current invention.

Without wishing to be bound by theory, the arches defined by the concave indentations provide an internal "roman arch" which resists deformation of the walls by compression forces. As the walls are compressed, the internal arch resists inward or outward flexing of the walls in a direction approximately perpendicular to the direction of the compression forces.

In an embodiment of the invention, the container will have a removable lid or flexible cover. By "lid" it is meant a rigid, semi-rigid or semi-flexible structure which covers the opening defined by the end walls and the side walls. For example the lid can be made of any suitable plastic material. By "cover" it is meant a non-rigid material such as but not limited to a canvas, a tarp or some other form of flexible cover.

In an embodiment of the invention, at least one of the upper edges of the end walls and/or side walls has a hinge means to pivotally attach a lid.

Figure 5:
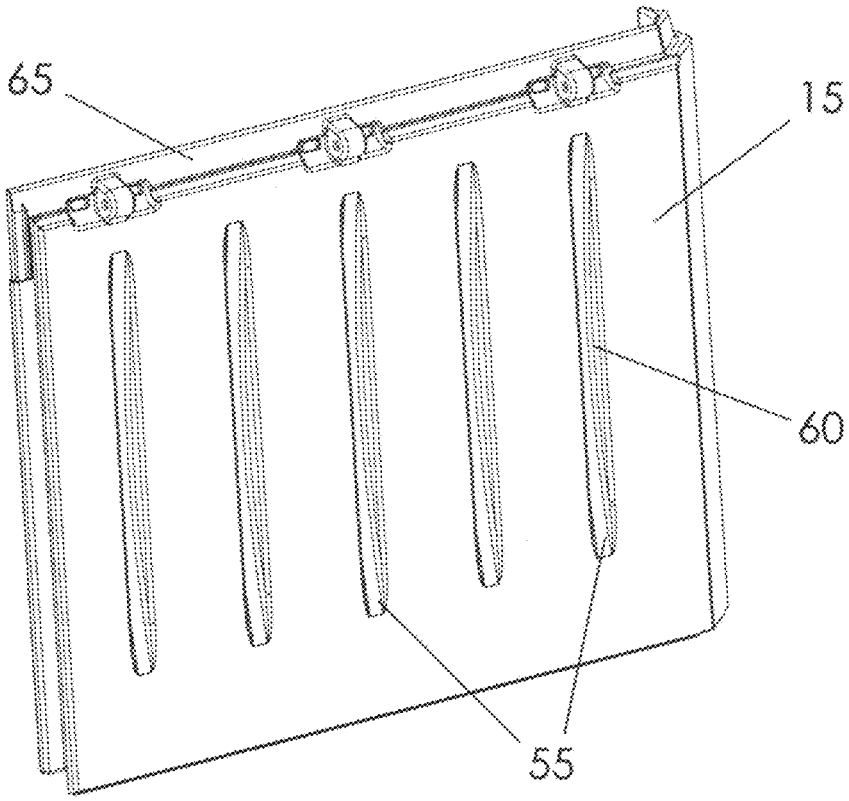
FIG. 5 shows a front perspective view of an end wall panel in an embodiment of the invention.

In an embodiment, at least one upper edge of the side walls and/or the end walls will have flange 65 which may serve as a lid engagement flange. The flange can be the taller edge of a pair of offset edges as shown in FIGS. 1A, 3B and 5. The flange 65 can help seat or align a lid component atop the container.

Optionally, a lid is partitioned into lid panels. The lid or lid panels may be integrally attached to the container by way of a hinge means, or it may be completely removable. Hence, a removable lid or lid panels which are attached to the container by snap hinges or which can be seated atop or snap fitted to an upper peripheral edge of the container are all contemplated for use with the current invention. The lid may optionally be a twinned wall plastic component, and may be rotomolded.

Figure 6:
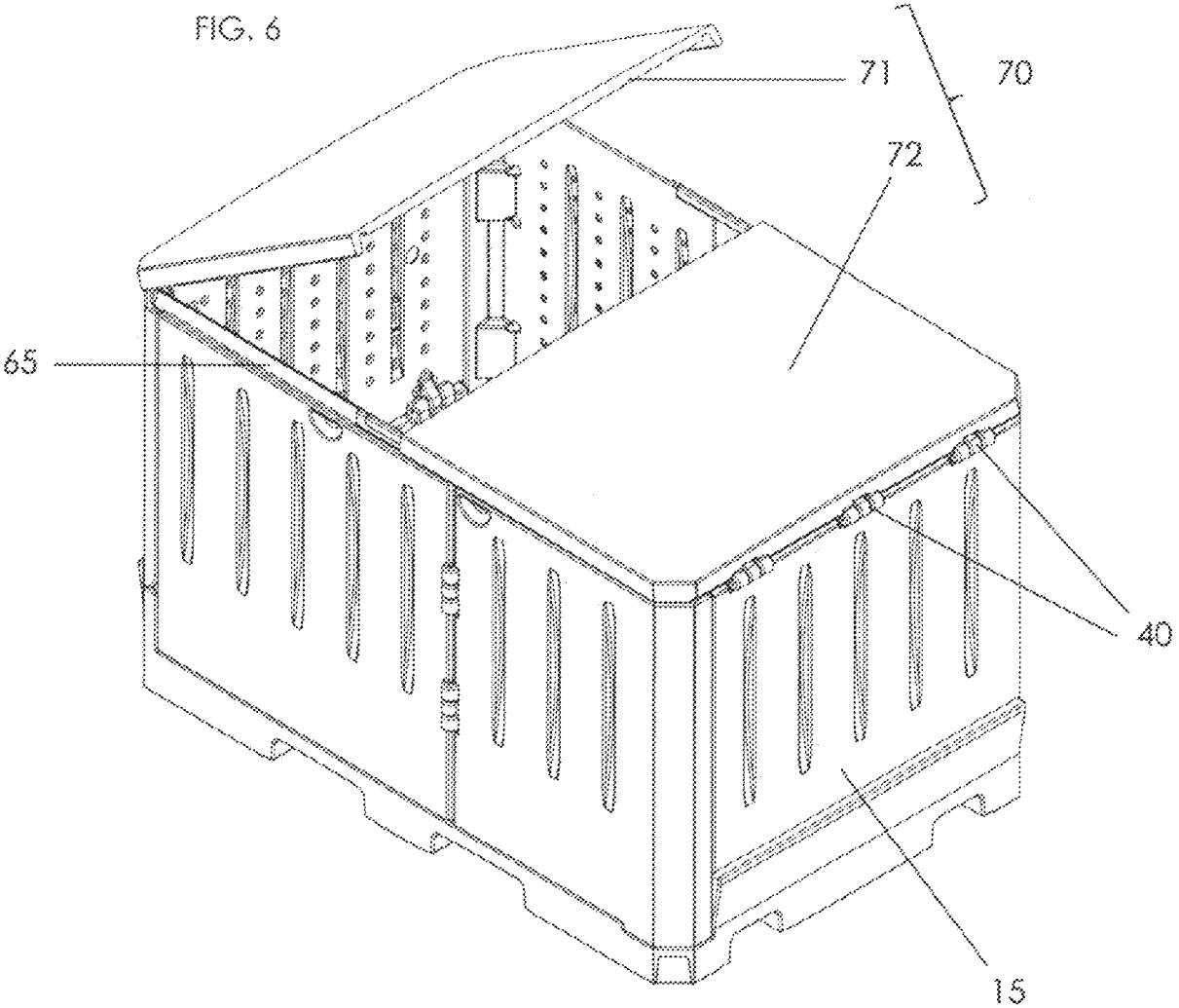
FIG. 6 shows a perspective view of an embodiment of the current invention.

With respect to FIG. 6, a specific embodiment of the invention having a pivotally attached lid, 70 is shown. The lid had two sections 71 and 72 which are pivotally attached to the end walls 15 along an upper edge, by one or more hinges 40. The hinges 40 are outwardly offset so as to permit a lid or lid panels to fold back on to the outer surface of the end walls.

Figure 7:
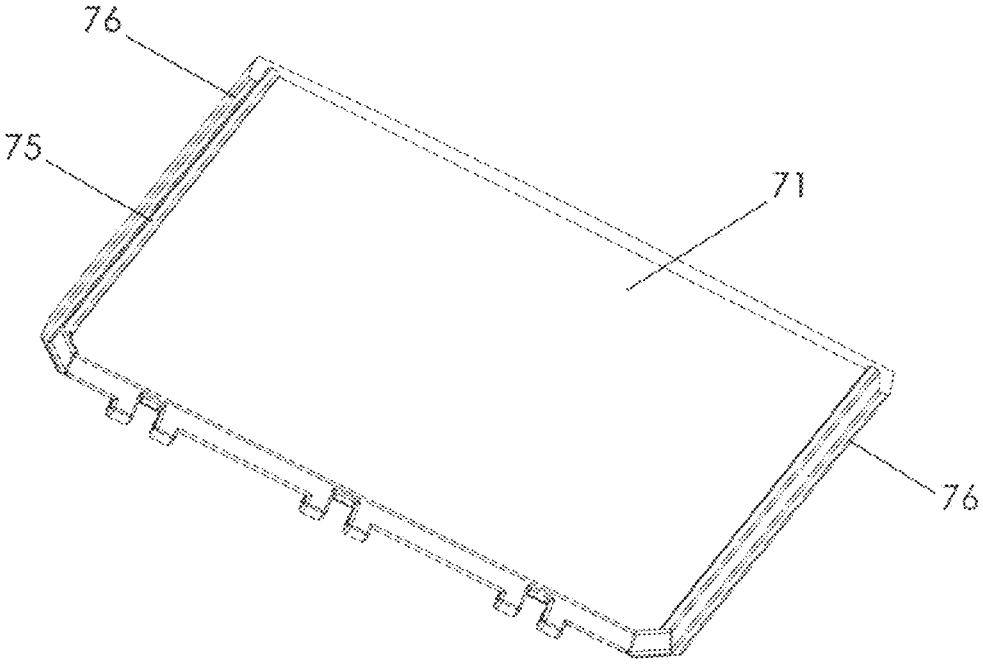
FIG. 7 shows a perspective view of a lid component in an embodiment of the current invention.

In an embodiment of the invention the lid will have on its lower perimeter surface a lid groove 75 to engage a flange 65 extending from one of more of the upper edges of at least one of the end walls and/or side walls. FIG. 7 shows the underside of one of the lid section, 71. Disposed on each lateral side is a lid groove 75. The lid groove engages the upper edges of the side walls (i.e. flanges 65). Optionally, the lid may also have a downwardly extending skirting wall 76 on its periphery, and which overlaps the upwardly extending flanged periphery presented by the combined upper edges of the side walls and end walls (see FIG. 6).

In an embodiment of the invention (see FIGS. 8A and 8B), the base 5 has spaced apart top and bottom surfaces 80 and 85 joined by a pair of base end walls 90 and a pair of base side walls 95. The base may also has two upwardly extending end retaining walls 100. The top surface 80 that is between the end retaining walls 100 may provide a recessed area for storing folded side wall panels.

In an embodiment, the base is a rotomolded plastic component having a twinned wall structure defined by an inner wall member and an outer wall member. For clarity, when the base is a twinned wall component, the upper surface 80 of the base will correspond to the inner wall member 45, and the lower surface 85 of the base will corresponds to the outer wall member 50.

Figure 8A:
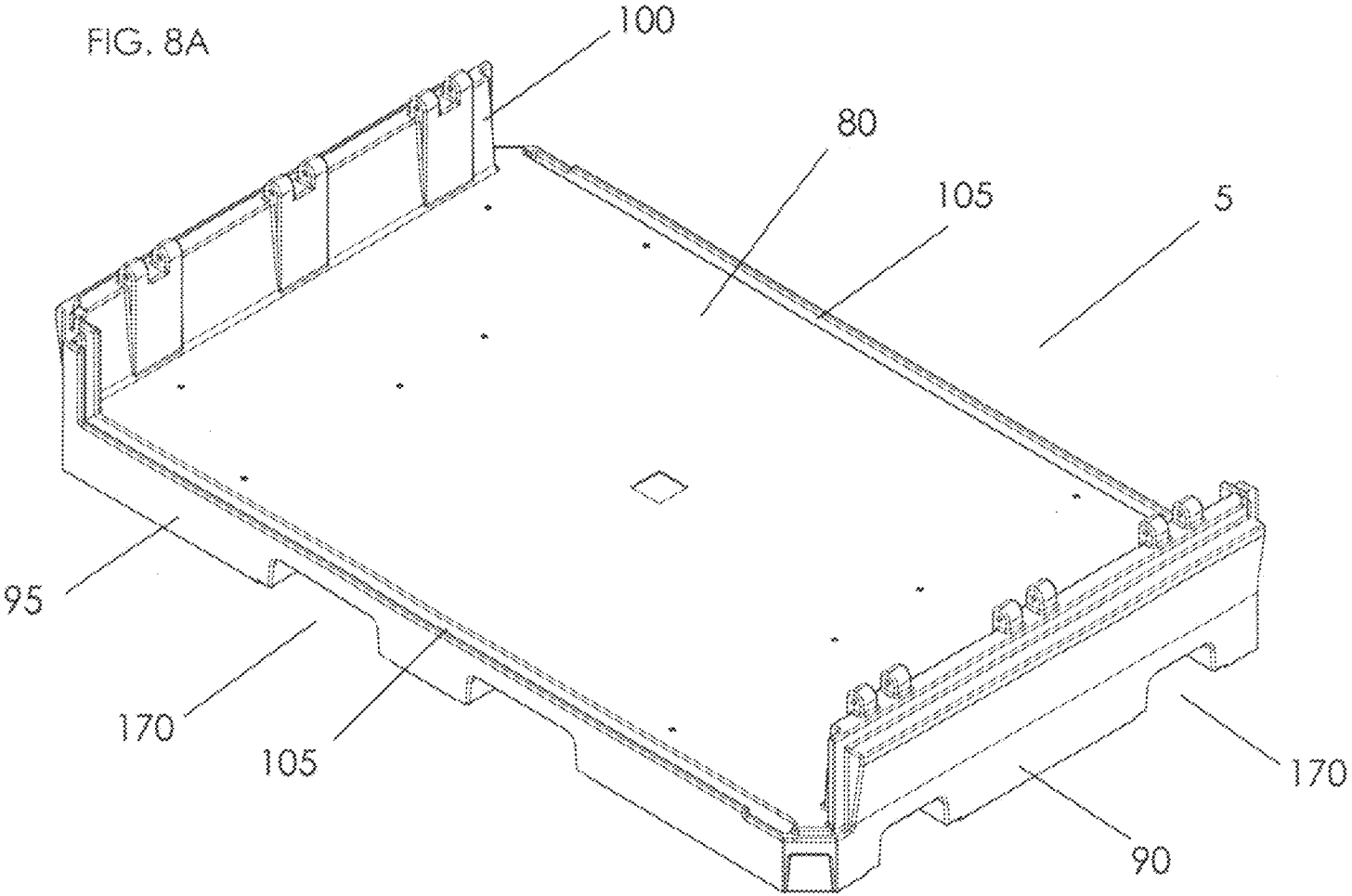
FIGS. 8A and 8B show perspective views of the base in an embodiment of the invention.
Figure 8B:
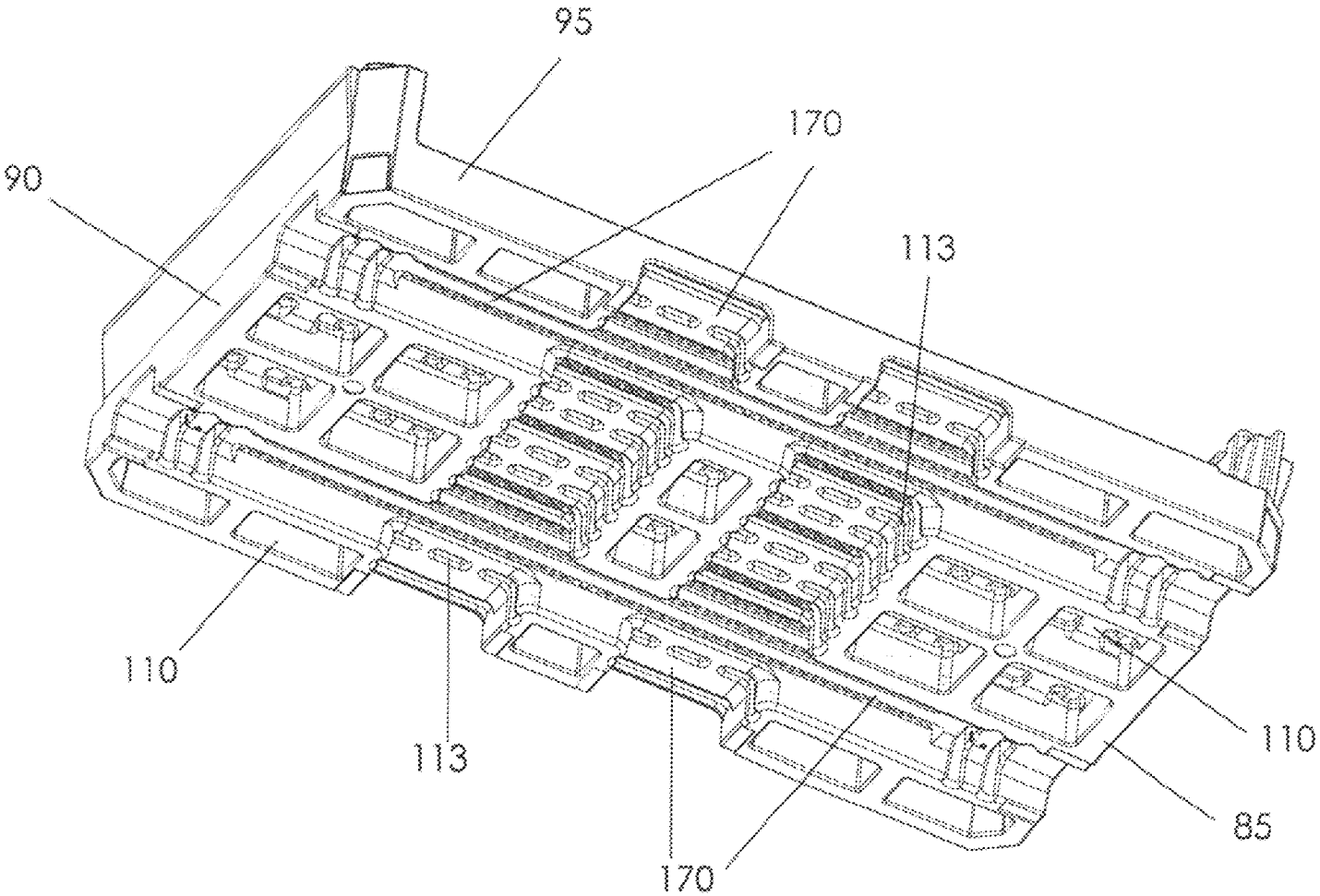

With reference to FIG. 8B, the base 5 may have one or more wells 110, which are areas in which the top and bottom surfaces, 80 and 85 are closer together than in other portions of the base. In a well, the inner and outer wall members do not actually touch one another. Without wishing to be bound by theory, the use of such wells may add structural rigidity and strength to the base.

Figure 9:
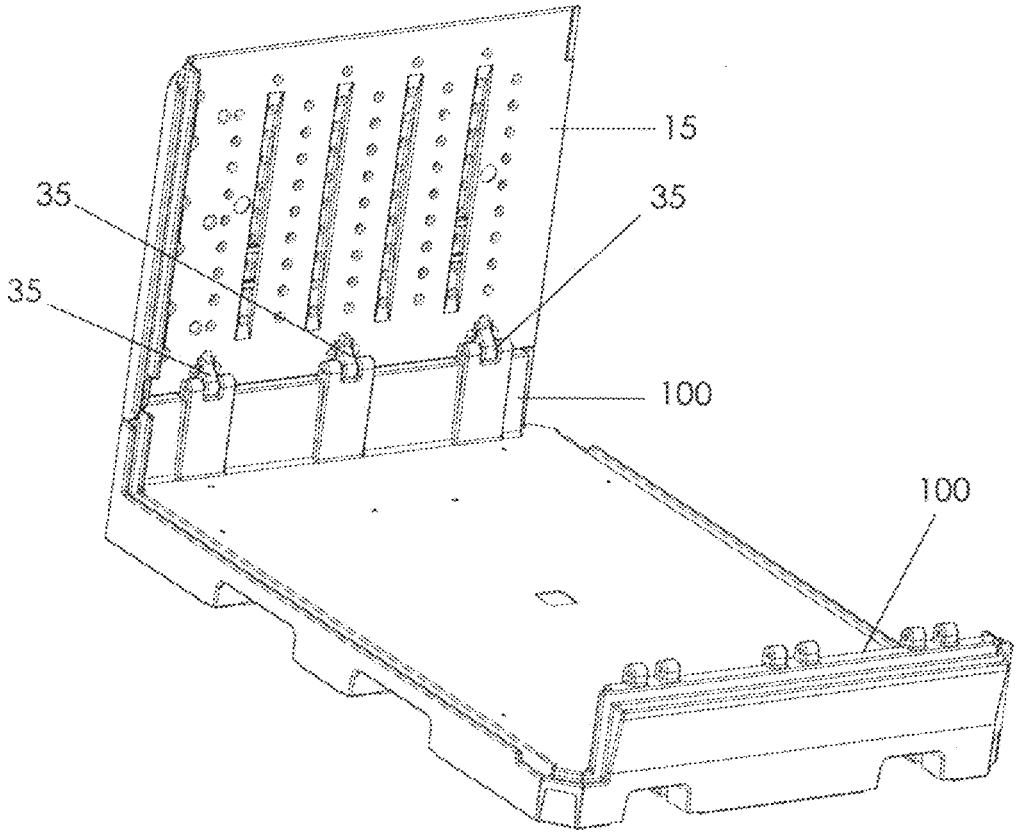
FIG. 9 shows a perspective view of an embodiment of the current invention.

With reference to FIGS. 1 and 9, in an embodiment of the invention, the container has end walls 15 which are pivotally attached to the end retaining walls 100 of the base by hinges 35.

In an embodiment, inwardly offset hinges 35 are used to attach the ends walls to the base. The use of inwardly offset hinges helps to prevent the end walls from folding outward beyond a substantially vertical erected position.

The end walls 15 and the end retaining walls 100 have abutting or mating adjacent edges. In a preferred embodiment, an outwardly offset pair of lower edges on the end walls 15 mate with an inwardly offset pair of upper edges on the end retaining walls 100 when an end wall of the container is an erect position, as shown further in FIG. 10.

In a specific embodiment of the invention, as shown in FIG. 8A, the base has a pair of lower grooves 105. Each lower groove is disposed in the top surface 80 of base 5 adjacent to each base side wall 95. Hence, the grooves 105 are disposed within opposite peripheral surfaces of the base near each base side wall 95. The lower grooves 105 form part of a tongue and groove means between the side walls 10 and the base (also see FIGS. 1A and 1B).

Figure 10:
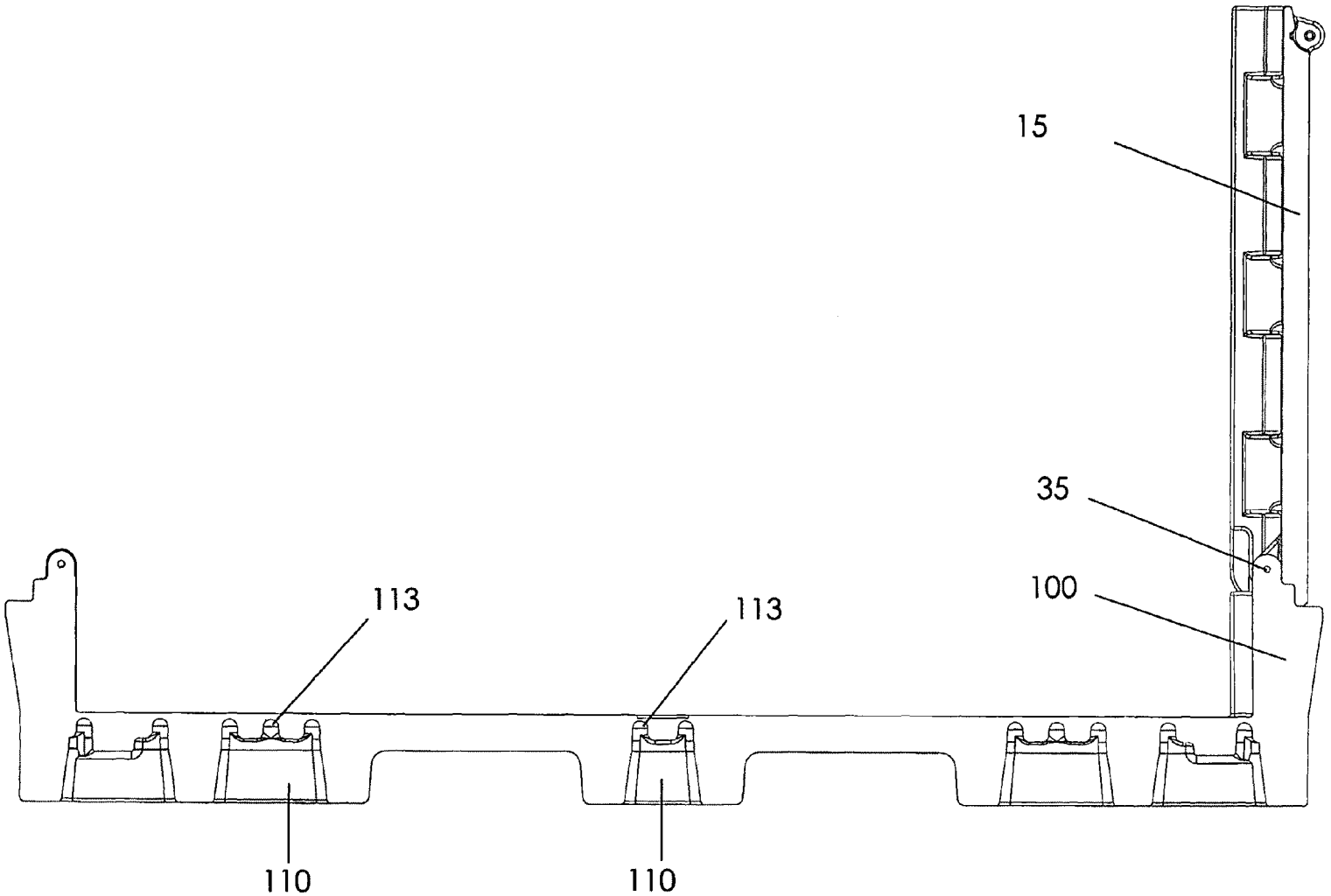
FIG. 10 shows a cross sectional front elevation view of an end wall and the base in an in an embodiment of the invention.

In an embodiment of the invention, and with reference to FIGS. 8B and 10, the base will have a plurality of "kiss offs" 113. The term "kiss off" refers to a point in a twinned wall component at which the inner and outer wall members 45 and 50 pinch together to make contact with one another. Kiss offs can be inward or outward facing indentations. Use of "kiss offs" in other parts of the collapsible container 1, such as the end walls or the side walls or the roof, is also contemplated by the current invention. It is well known in the art that "kiss offs" increase the structural rigidity and strength of a twinned wall component. The kiss offs may be of any suitable shape, including but not limited to circular, elongate, or oblong. Kiss offs 113 are distinguished from wells 110 in that they represent areas in which the inner and outer wall members make contact with one another.

Figure 11A:
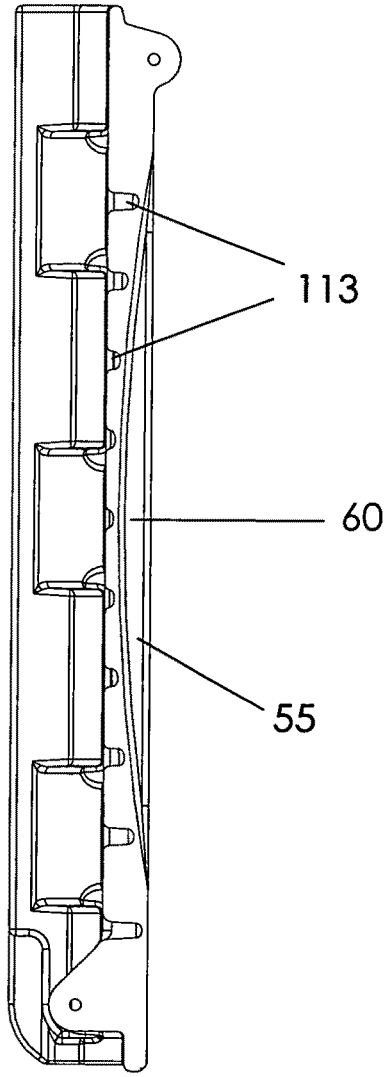
FIG. 11A shows a cross sectional elevation view taken through an outwardly facing concave indentation of an end wall in an embodiment of the invention.
Figure 11B:
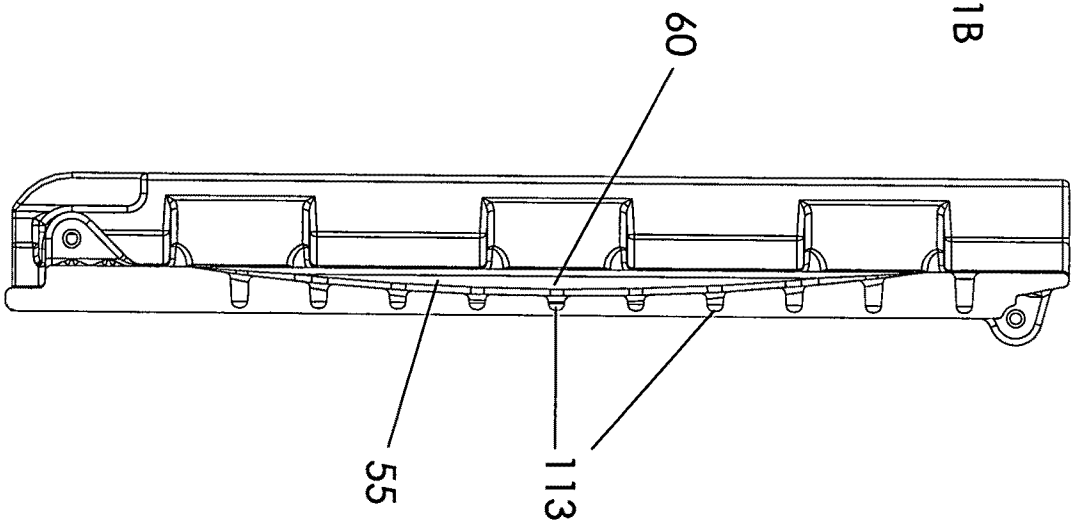
FIG. 11B shows a cross sectional elevation view taken through an inwardly facing concave indentation of an end wall in an embodiment of the invention.

In an embodiment of the invention, one or more kiss offs are aligned with or incorporated within the concave indentations 55 in one or more of the end walls 15 or the side walls 10 so as to provide points of contact between said inner and outer wall members (see FIG. 11A which shows the alignment of kiss offs with a concave indentation of an end wall and FIG. 11B which shows the incorporation of kiss off within the concave indentation of an end wall). By placing kiss off structures in alignment with or within the concave indentations, the inner and outer wall members are held in an approximately parallel fashion under load bearing forces. Without wishing to be bound by theory, holding the inner and outer wall members approximately parallel to one another enhances the load bearing capacity of the walls by enhancing the function of the elongate concave indentations as perpendicular roman arches which resist inward and outward flexing motions.

In an embodiment of the invention, one or more kiss offs are aligned with or incorporated within the wells 110 in the base 5, so as to provide points of contact between said inner and outer wall members (see FIG. 10). By placing kiss off structures in alignment with or within the wells 110 further structurally rigidity may be imparted to the base.

In an embodiment of the invention, one or both of the side walls 10 reversibly engage a peripheral surface of the base 5.

In an embodiment of the invention, the lower edges of the side walls 10 engage lower grooves 105 in the upper surface 80 of base 5. In another embodiment of the invention, each side wall has a pair of offset perimeter edges, one edge of which engages lower grooves 105 in the upper surface 80 of base 5 (i.e. a tongue and groove engagement). A reversed tongue and groove means, in which grooves present in the lower edges of the side wall mate with a tongued track on the base, is also contemplated by the current invention.

In an embodiment of the present invention, the side wall panels 11 and 12 will have a slide lock which rides along a common upper edge of adjacent side wall panels.

Figure 12A:
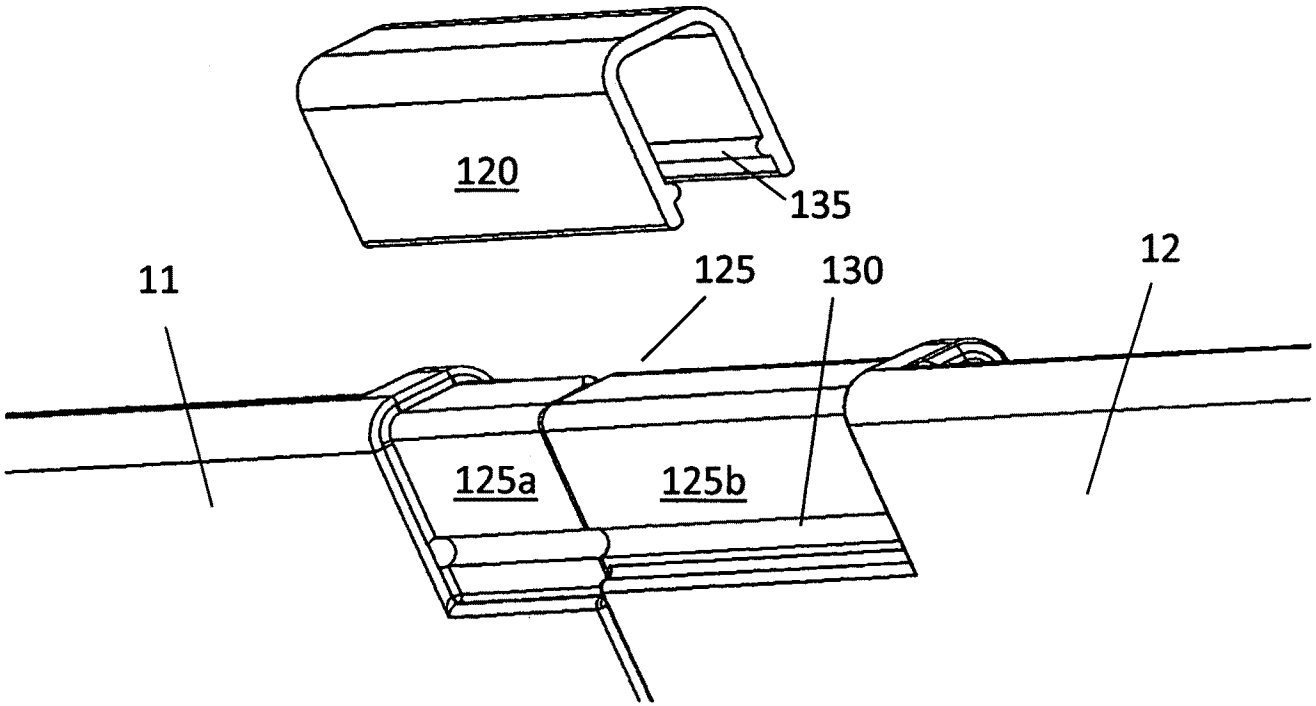
FIG. 12A shows an exploded perspective view of the slide lock in an embodiment of the current invention.
Figure 12B:
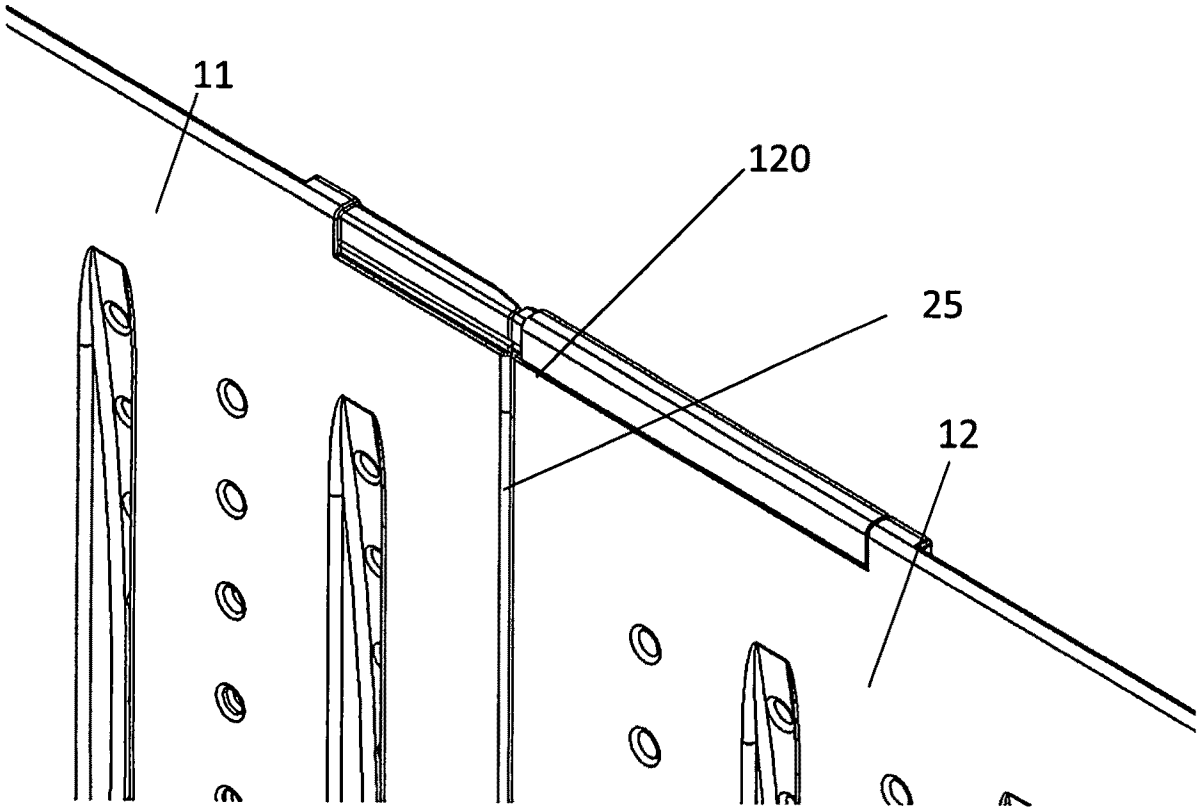
FIG. 12B shows a perspective view of the slide lock in an open position for an embodiment of the invention.
Figure 12C:
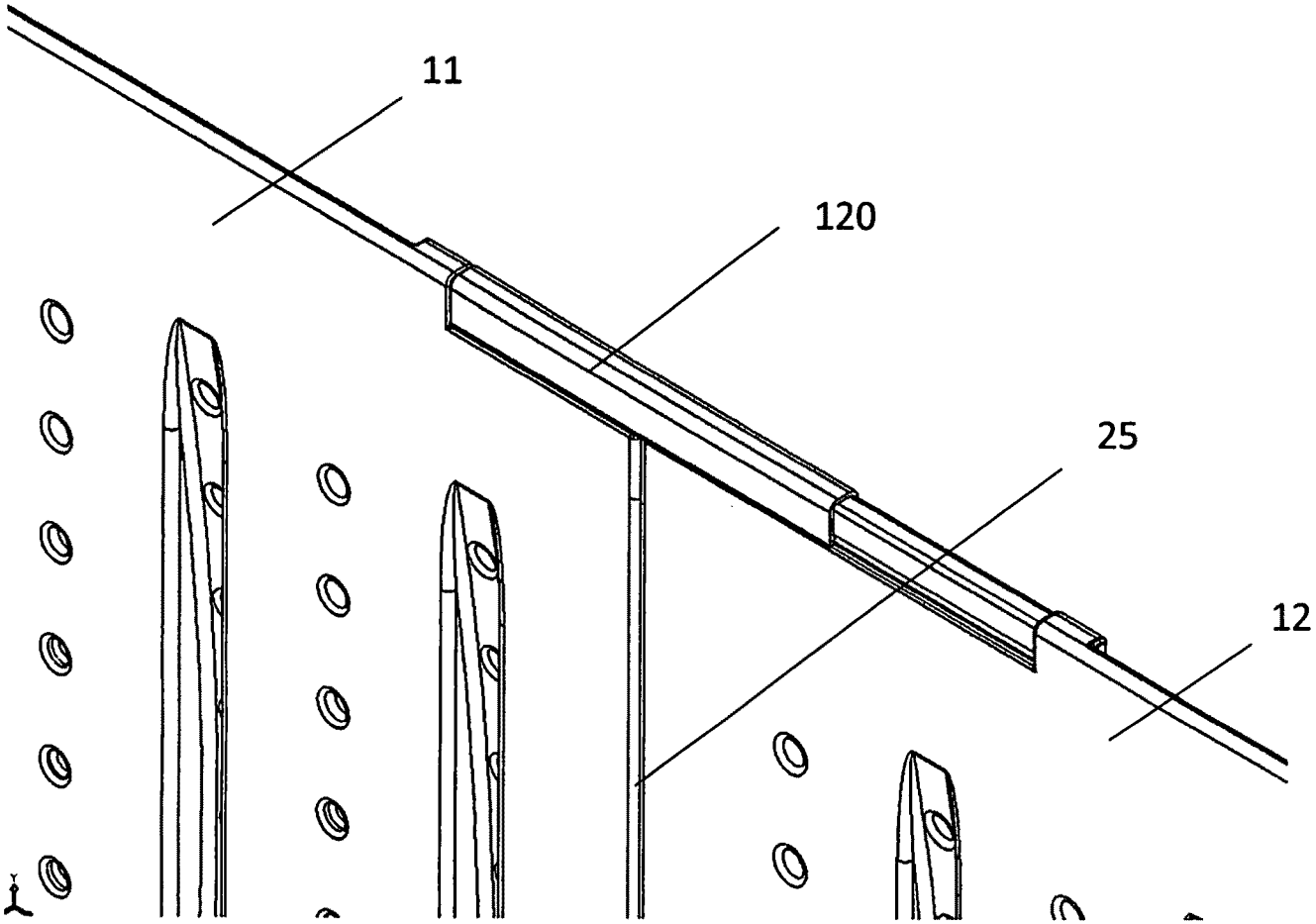
FIG. 12C shows a perspective view of the slide lock in a closed position for an embodiment of the invention.

In an embodiment of the invention and with reference to FIGS. 12A-12D, the slide lock comprises a partially tubular component 120 which engages the side wall panels of a side wall, and which slides between an open position and a closed position. With reference to FIGS. 12A-12C, the tubular component 120 rides on a track 125 molded within and along a common upper edge of adjacent side wall panels and near the vertical axis 25 about which side wall panels (e.g. 11 and 12) are pivotally attached to one another. With reference to FIG. 12A, the track 125 is made up of a portion 125*a* along an upper edge of side wall panel 11 and a portion 125*b* along an upper edge of side wall panel 12. Each portion of the track is proximal to the vertical axis 25.

When in the open position, the slide lock resides on a portion of the track entirely within either side wall panel (i.e. entirely within side wall panel 11 or 12). When in a locked position, the slide lock will traverse the vertical axis 25 about which the side wall panels are pivotally attached to one another, thereby preventing pivoting motion about the axis 25.

In embodiment, when in the open position, the partially tubular component 120 resides on a portion of the track entirely within the larger of the two side wall panels (i.e. portion 125*b* in side wall panel 12 as shown in FIG. 12B). With reference to FIG. 12C, when in a locked position, the partially tubular member 120 will traverse the vertical axis 25 about which the side wall panels are pivotally attached to one another, thereby preventing pivoting motion about the axis 25. Preferably, the track is dimensioned so as to provide a stop against which the partially tubular component 120 abuts when in either the locked or unlocked positions, and which prevents the partially tubular member from sliding to locations highly distant from the vertical axis 25.

Figure 12D:
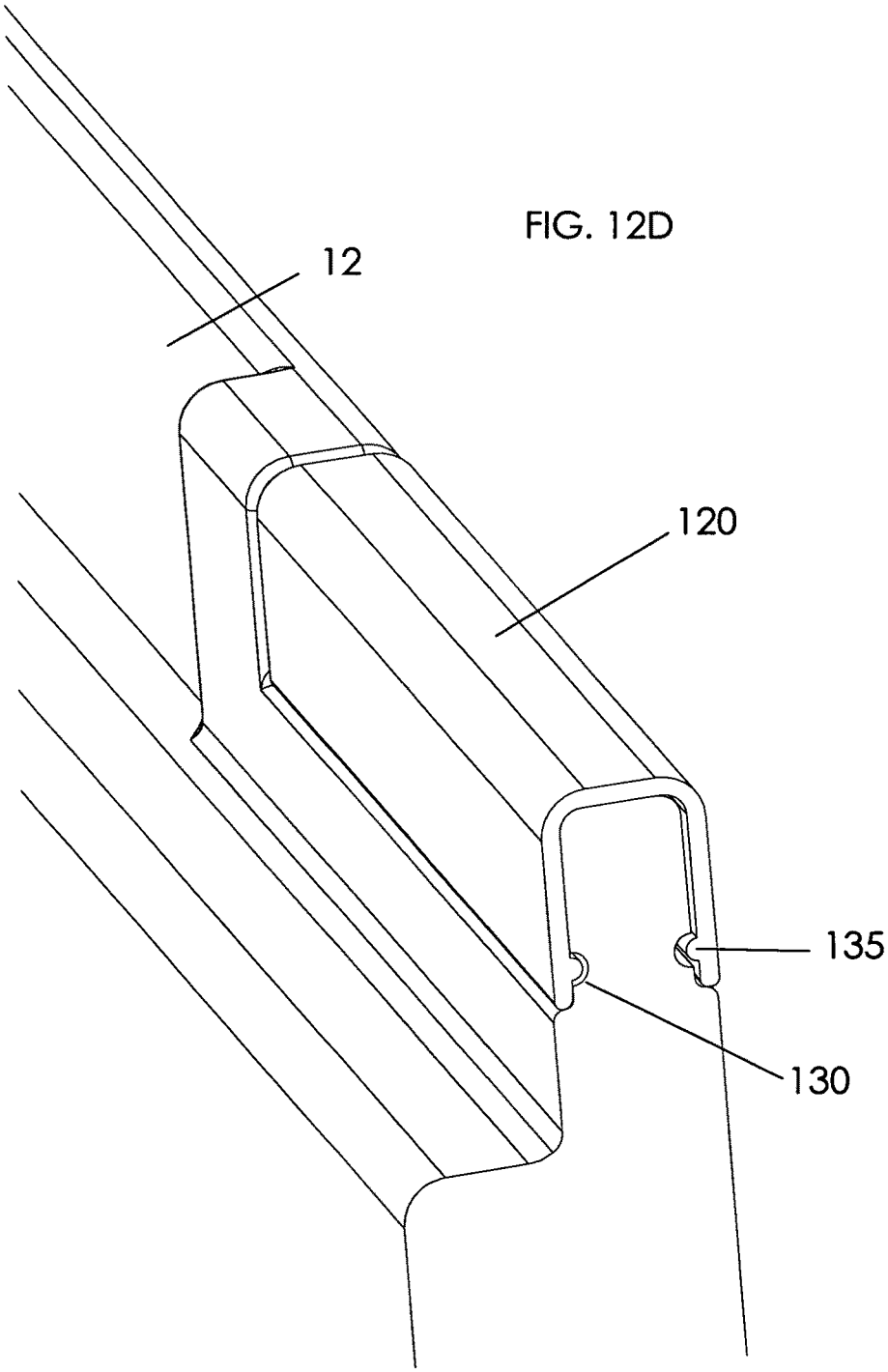
FIG. 12D shows a perspective cross sectional view of the slide lock in an embodiment of the invention.

The partially tubular member 120 has an elongate opening or open side which accommodates and engages the track 125. In a specific embodiment, the tubular member has a "U" shaped cross section which engages the track as shown in FIG. 12D. The shape of the tubular member 120 and the track 125 are not of particular importance, so long the tubular component can slide along said track. The tubular component can be made from a wide variety of materials including various plastics, composites, and metals so long as the material has sufficient strength to avoid cracking or breaking when in a locked position and when inward or outward pressure is applied to the side wall panels. Preferably the tubular component is made of metal.

In an embodiment of the invention, and with reference to FIGS. 12A and 12D, the track will comprise a pair of track grooves 130 which receives a pair of elongate protrusions 135 present on the inner surface of the partially tubular member 120. The track grooves 130 and protrusions 135 may be of any shape, so long as they hold the tubular member 120 on the track 125.

In another embodiment the track will comprise a plurality of parallel detents which receive a plurality of parallel protrusions on the inner surface of the tubular member.

Other variations of the slide lock may be used with the current invention, so long as the slide lock comprises a slidable component engaging an upper edge of a side wall so as not to fall off, and which when in a locked position traverses the axis 25 so as to prevent the inward folding of a adjacent side wall panels.

In an embodiment, the tubular component 120 and the track portions 125*a* and 125*b* are preferably dimensioned so as not to interfere with mutually engaging, mating or abutting edges of a side wall and an optional lid.

In a specific embodiment, the tubular component 120 and the track portions 125*a* and 125*b* must be of sufficiently small and/or narrow dimensions to allow the entire slide lock to nest within the peripheral edges of an optional lid.

In an embodiment, the upper edges of the side walls panels have a flange which engages a complimentary groove 75 in the underside of an optional lid. The slide lock is dimensioned to form part of the flange on the upper edge of the side wall panels.

In an embodiment, and with reference to FIGS. 12A to 12D, the track is molded within a widened portion of the upper edge of a side wall. Preferably, the track is dimensioned so as to provide a stop against which the tubular component 120 abuts when in either the locked or unlocked positions, and which prevents the tubular member from sliding to locations highly distant from the vertical axis 25.

In the present invention the end walls and the side walls reversibly engage one another along adjacent edges.

In an embodiment, the end walls, the retaining walls and the side walls have along one lateral edge a corner extension.

Figure 3C:
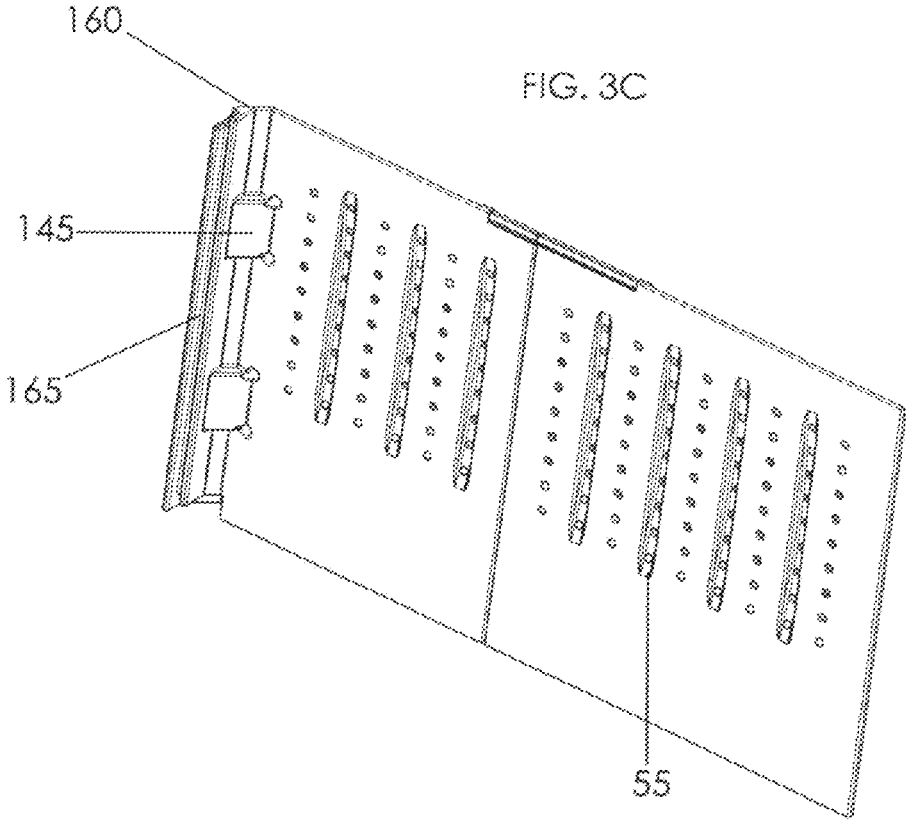
FIG. 3C shows a rear perspective view of a side wall an embodiment of the invention.
Figure 13:
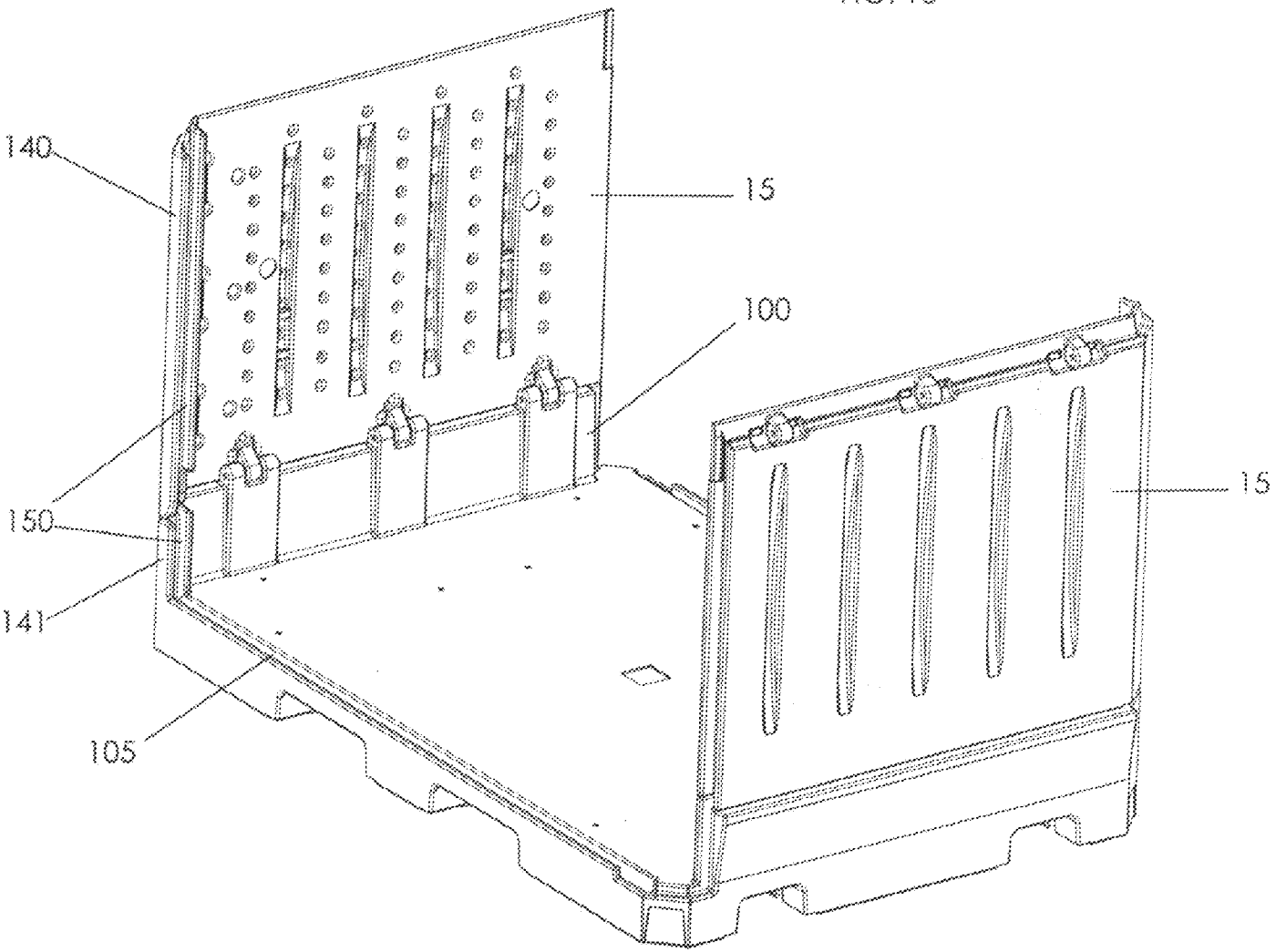
FIG. 13 shows a perspective view of an embodiment of the current invention.
Figure 14:
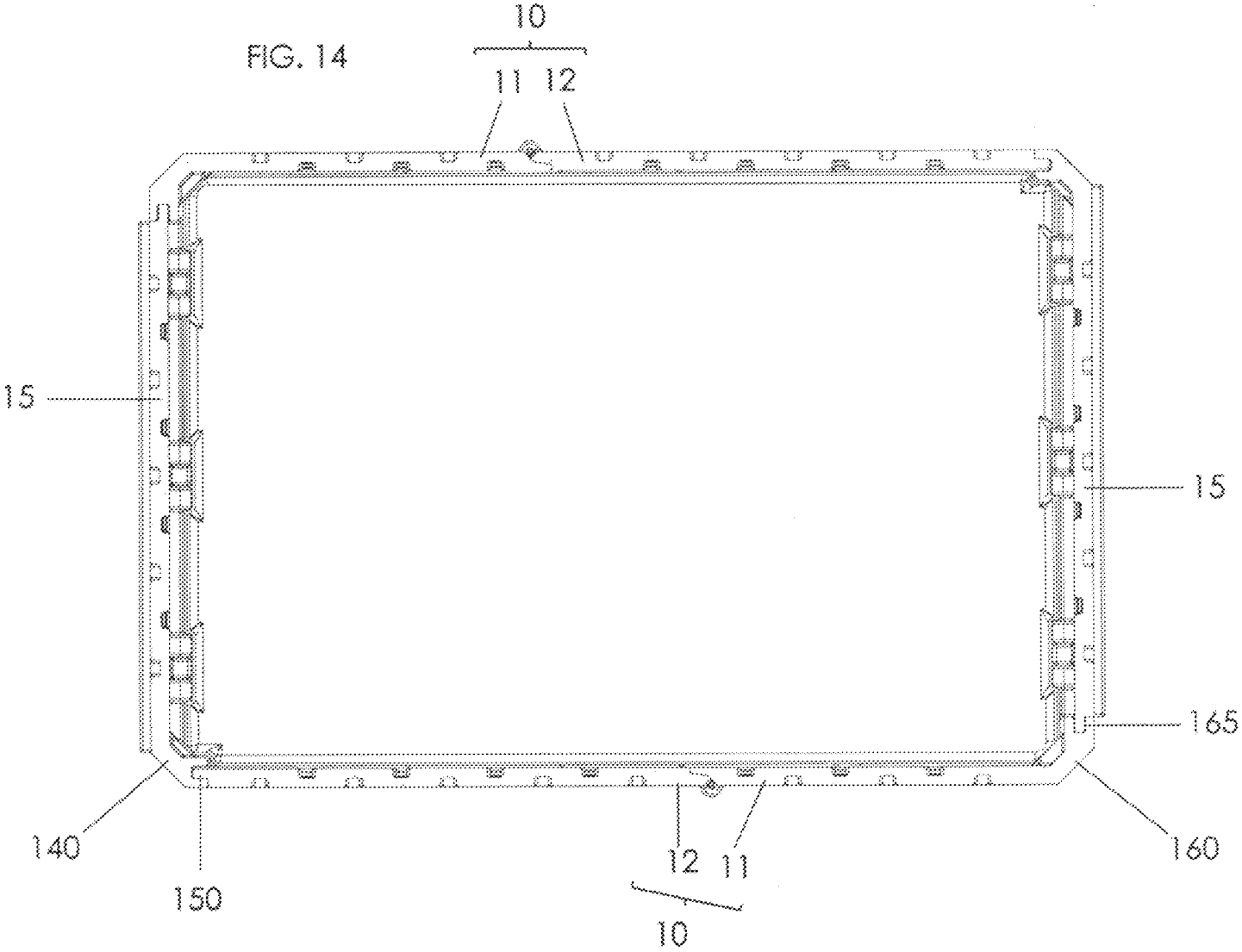
FIG. 14 shows a cross sectional plan view of the end walls and side walls of an embodiment of the invention.
Figure 15:
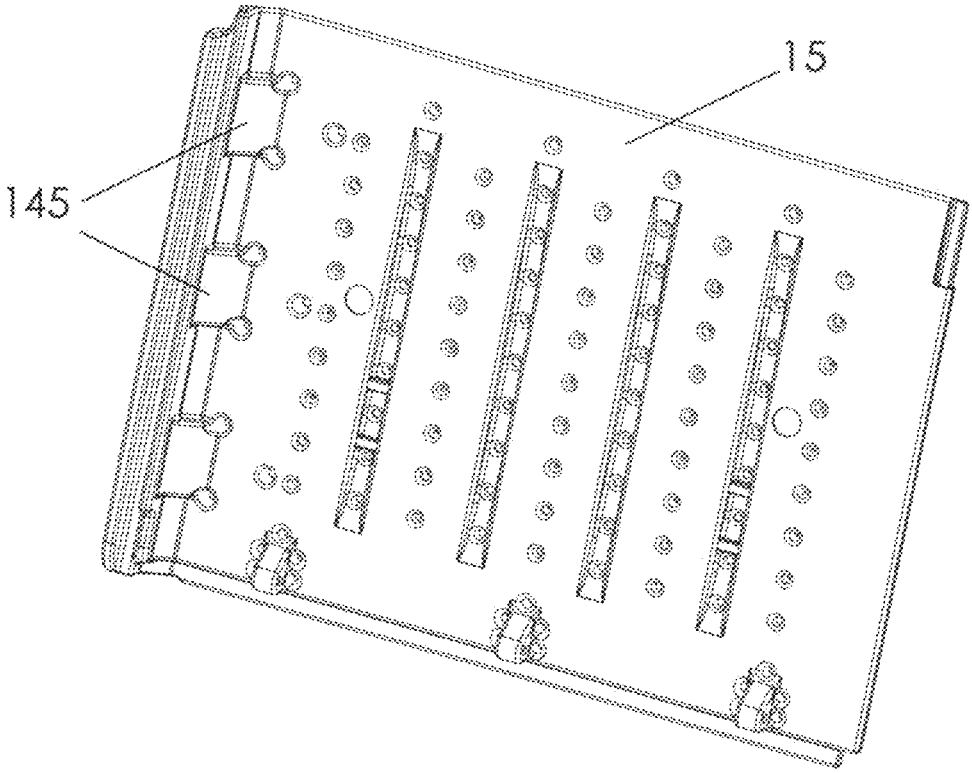
FIG. 15 shows a rear perspective view of an end wall panel in an embodiment of the invention.

In an embodiment, the corner extension on the end walls and the end retaining walls reversibly engages an adjacent edge of the side walls by a tongue and groove means, and the corner extension on said side walls reversibly engages an adjacent edge of said the walls by a tongue and groove means. With reference to FIGS. 13 and 14, the end walls 15 and the retaining walls 100 have on one lateral side, perpendicular corner extensions 140 and 141 respectively, which mate with an edge of an adjacent side wall 10 to define a pair of vertical corner sections. Hence, the end walls may have an L-shaped cross section. The L-shaped end walls may optionally be reinforced by integrally molding a rib 145 within an inner corner. The rib can be present in any number and can take any number of shapes (see FIG. 15). With reference to FIGS. 13 and 14, the corner extensions 140 and 141 have a first vertical groove 150 disposed therein which engages an offset edge of an adjacent side wall 10 (a tongue and groove type fit). A reversed tongue and groove interaction, in which the groove 150 is present in an adjacent edge of the side wall and mates with a tongued vertical track, an offset edge or flat edge along the corner extensions 140 and 141 is also contemplated for use in the current invention. The side wall may also have a non-offset edge (i.e. flat edge) which directly engages the groove 150 of the end wall, and the end retaining wall. With reference to FIGS. 3B, 3C, 4 and 14, the side walls 10 have on one lateral side a perpendicular corner extension 160 which mates with an edge of an adjacent end wall 15 to define a second pair of vertical corner sections. Hence, the side walls and more particularly the side wall panels 11, may have an L-shaped cross section. The L-shaped side wall panels may optionally be reinforced by integrally molding a rib 145 within an inner corner. The rib spans the perpendicular sections of the L-shaped side wall panels to strengthen the same against inward and/or outward bending or flexing. The rib can be present in any number and can take any number of shapes (see FIG. 3C). With reference to FIGS. 3C and 14, the corner extensions 160 have a second vertical groove 165 disposed therein which engages an offset edge of an adjacent end wall 15 (a tongue and groove type fit). A reversed tongue and groove interaction, in which the groove 165 is present in an adjacent edge of the end wall and mates with a tongued vertical track, an offset edge or flat edge along the corner extension 160 is also contemplated for use in the current invention. The end wall may also have a non-offset edge (i.e. flat edge) which directly engages the groove 165 of the end wall.

Figure 16:
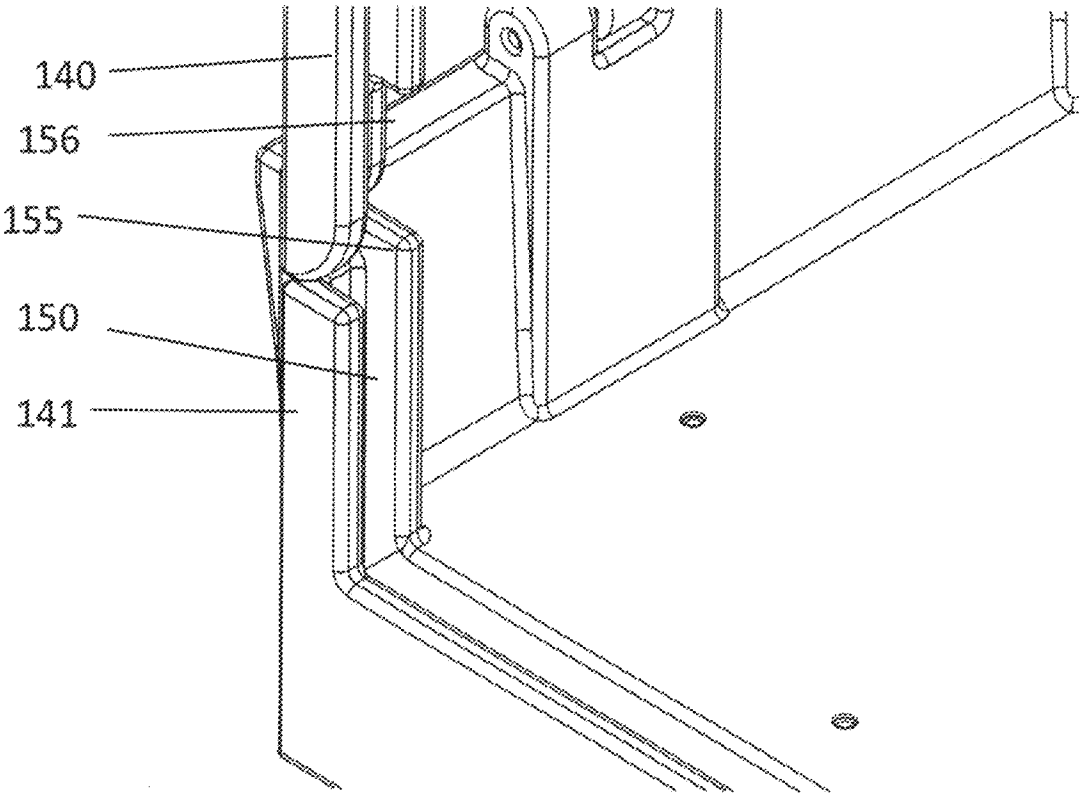
FIG. 16 shows a partial perspective view of an embodiment of the invention.

To facilitate inward folding of the end walls, the corner extensions 140 on an end wall have a beveled lower end. The corner extension 141 on the end retaining walls can have a squared or beveled upper end. In one embodiment of the invention, the corner extensions 140 and 141 on the end wall panels and the end retaining walls respectively have adjacent beveled and squared end surfaces which evenly abut one another (not shown). This arrangement leaves a small space between corner extensions 140 and 141. Preferably, the corner extensions 140 and 141 on the lower end wall panel and the end retaining wall respectively have adjacent beveled and squared end surfaces which abut one another unevenly as shown in FIG. 16. The upper end of corner extension 141, inward of grove 150, has an upwardly extending portion 155 which overlaps with the space between corner extensions 140 and 141, outward of groove 150, providing additional weatherproofing for erected container 1. The corner extension 140 on the end wall 15 has a cutout 156 inward of groove 150, which mates with the upwardly extending portion on corner extension 141 when the container is collapsed.

In the present invention, the side walls and ends walls are held together by use of their reversibly engaging side edges (see for example FIG. 14). Optionally, the engagement between adjacent side and end walls (i.e. at the corners of the container) can be strengthened or fortified by using a fastening means. Hence, in an embodiment of the invention, the side walls and the end walls will be secured together along adjacent edges with a fastening means. The fastening means, can be any suitable structure known in the art. Some non-limiting examples include hook and loop, latch member and latch catch, threaded fasteners such as a nut and bolt or bolt and threaded receptacle (which is optionally integrally molded or added to a side or end wall), over center latch mechanisms and the like. The fastening means can be integrated into the end walls and side walls or fixed to the inside and/or outside surfaces of the end walls and side walls using staples, screws, bolts, clamps, brackets, welds, glue, or other suitable methods of attachment which are known in the art. The fastening means may also be integral with a lateral edge of a side wall or an end wall or fixed to a lateral edge of a side wall or an end wall. For example adjacent side and end walls may have complimentary latch and latch receiver means.

In an embodiment of the invention, the fastening means comprises an over center latch mechanism. An over centre latch generally comprises a latch member which traverses the seam present between adjacent wall members (i.e. an end wall adjacent to a side wall) so as to engage a latch member receiver on the far side of the seam. For example, a latch member receiver may be mounted on first wall member proximal to the seam (e.g. a lateral surface position of an end wall), while the latch member and a latch assembly housing the latch member can be mounted on an adjacent wall member proximal to the seam (e.g. on a lateral surface position of a side wall) so as to align with one another. Fastening means which comprise an over center latch mechanism are well known in the art, several variations of which are commercially available.

In order to facilitate movement of container 1, the base may have cut outs 170 which accommodate a pair of tines or prongs approaching the container along an axis substantially perpendicular to the side walls and/or substantially perpendicular to the end walls (see FIGS. 1A, 8A and 8B). The cut outs 170 form depending tine slots and can be integrally molded in base 10 with spacing to accommodate the tines of a forklift, a hand push pallet mover, a hand jack or other suitable device having tines or lift members which engage complimentary slots. A person skilled in the art will recognize that several configurations of cuts outs 170, with varying dimensions would be possible for use with the current invention, so long as pair of forklift tines or other lift members can be accommodated from at least one direction perpendicular to either the end walls or the side walls. The cut outs 170 are distinct from the wells 110 in that they open the base end walls or the base side walls to receive a set of tines or lift members. In contrast the wells 110 are inside the perimeter edges of the base and do not receive tines or other lift members.

In an embodiment, the top surface 80 of the base 10 immediately inward of lower groove 105 is vertically higher than the top surface 80 of the base 10 immediately outward of lower groove 105, so that liquid entering the lower groove 105 will not flow into the container 1.

In an embodiment, the lower grooves 105 contain drainage holes.

The side walls 10, side wall panels 11 and 12 and the end walls 15 can have one or more than one handle.

The hinges 30, 35, and 40 can be made of rotomolded plastic or any other suitable material. The hinges 30, 35 and 40 have male and female components which can be optionally integrally molded with their corresponding base, end wall, side wall or optional lid components. A person skilled in the art will know that a hinge will have a hinge pin, which holds the male and female components together by threading through a common bore.

The incorporation of an insulating or structural material between the inner and outer wall members 45 and 50 respectively, of each twinned wall component is also contemplated by the current invention. By way of a non-limiting example, a foamed plastic or expandable cellular plastic may be used as an insulating material The insulating material can be added during or after the rotomolding process used to rotomold a wall component as is well understood by persons skilled in the rotomolding art field.

The base 5 can be reinforced by any method known in the art to strengthen plastic pallets, including for example the incorporation of metal, plastic or composite reinforcing bars, ribbing, columns, posts or studs.

In a particular embodiment, in order to collapse the container, the optional lid or cover is removed or opened, the optional fastening means are released, and the side walls 10 are removed. If a lid or lid panel is pivotally attached to one or more end walls, then the lid or lid panel can be folded back onto the outer surface of the end wall so as not to interfere with other steps to collapse the container. To remove a side wall, the side wall is lifted vertically to unseat the side wall from the tongue and groove means between the side wall and the base and to disengage the mutually engaging edges between side wall and end walls (i.e. the lower edge of a side wall is disengaged from a groove in the peripheral surface of the base). After the side walls have been removed, end walls 15 are lowered onto the base 5 through an inward pivoting action. Optionally, the side walls can be placed in the recessed area between the upwardly extending end retaining walls 100 on the top surface 80 of the base 10, before the end walls are lowered. To facilitate the storage of side walls on base 100, the slide lock can be opened so that the side wall panels can be folded back on themselves along the vertical axis 25 (note that the slide lock can also be opened before removing the side walls).

In an embodiment, the container 1 is dimensioned such that the folded side walls 10 and the end walls all lie within the perimeter of base 5, when in a fully collapsed state.

Figure 17:
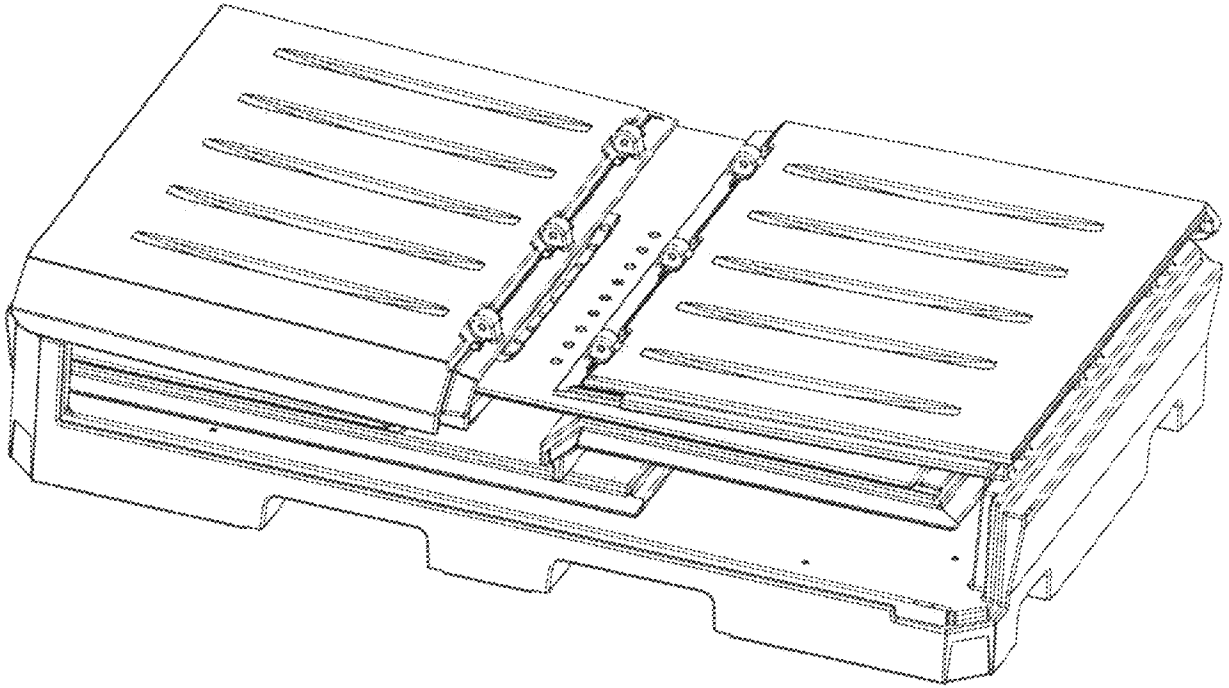
FIG. 17 shows a perspective view of an embodiment of the current invention.

A fully collapsed container is shown in FIG. 17.

Figure 18:
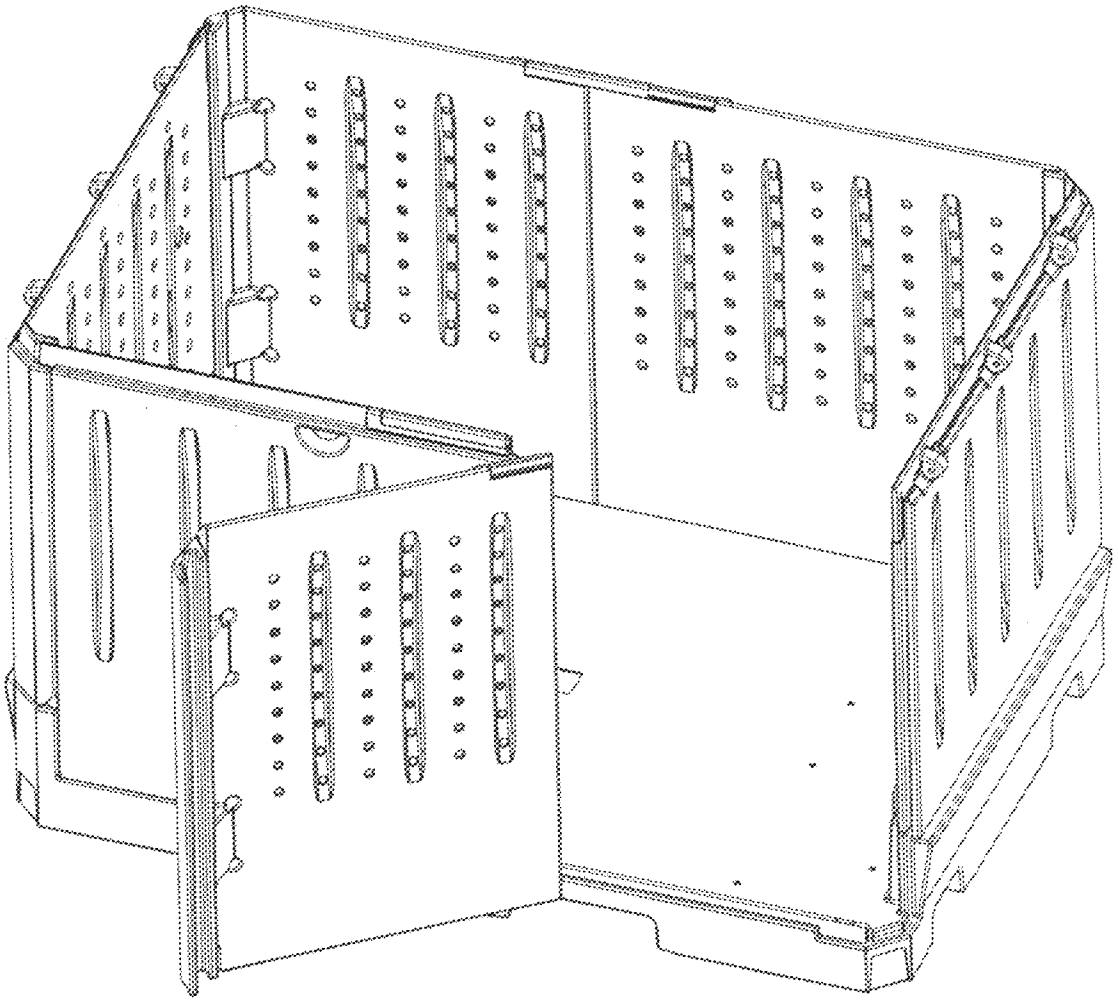
FIG. 18 shows a perspective view of an embodiment of the current invention.

In a particular embodiment, in order to erect the container, the above steps are reversed: the end walls 15 are erected to a vertical position, the side walls are unfolded and put in place between the end walls. To add the side walls, the lower edge of a side wall is seated within a groove in a peripheral surface of the base (i.e. the tongue and groove means between the side walls and the base is engaged). The mutually engaging edges of the side wall and adjacent end walls are likewise engaged, optionally by dropping the side walls into place between two erected end walls. Next, the fastening means, if present, are secured to hold the end walls and side walls rigidly in place. Finally, the optional lid or cover is fitted to the upper edges of the end walls and the side walls, or optionally, if a lid or lid panels are pivotally attached to the end walls, they are folded down over the container top. If an erected container having an open front and/or back is desired, then the side wall panels may be folded back on themselves about axis 25 prior to seating the side wall within the tongue and groove means between the side walls and the base and between the side wall and an end wall. For example, side wall panel 11 can be folded away from the container interior prior to engaging side wall panel 12 with the end wall and the base (i.e. seating into vertical groove 150 and seating within lower groove 105) as shown further in FIG. 18.

Figure 19:
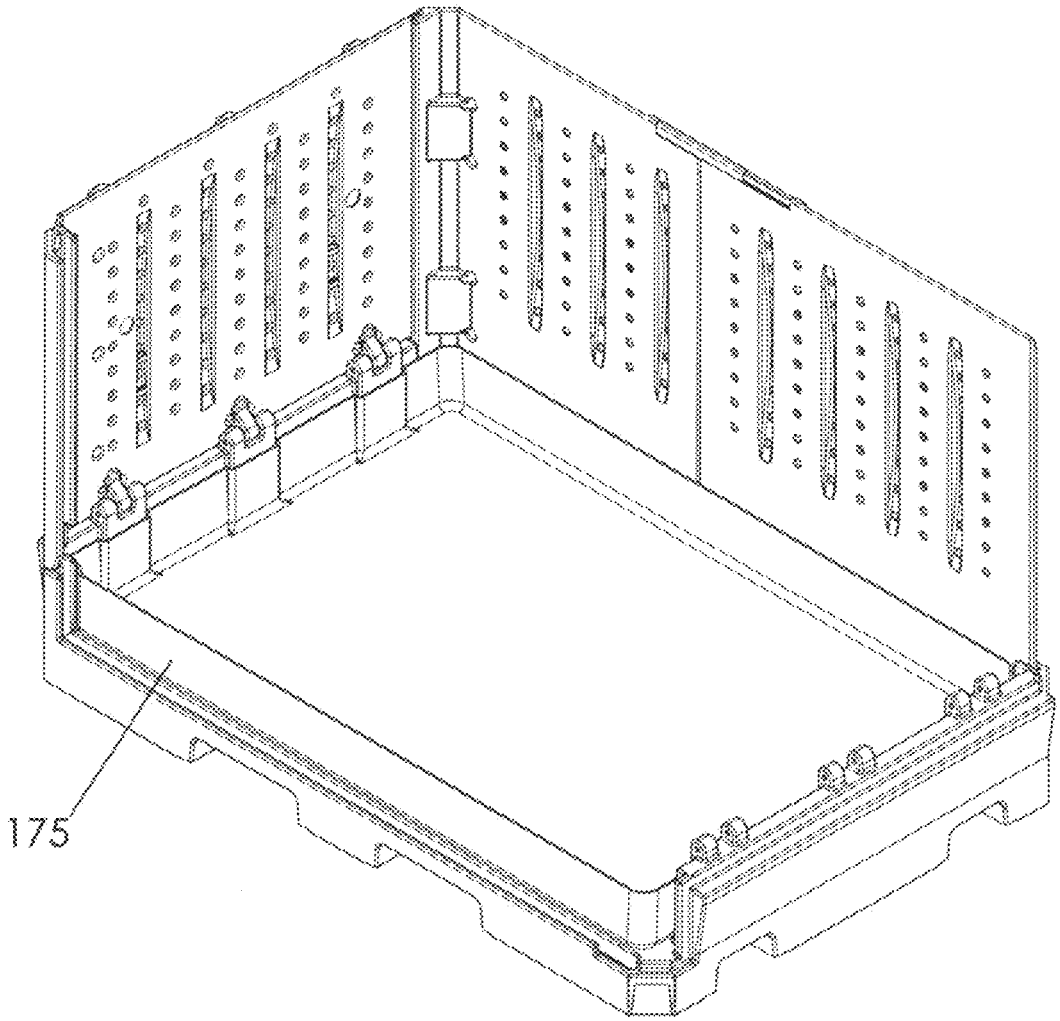
FIG. 19 shows a perspective view of an embodiment of the current invention.

In an embodiment of the invention, the container may be fitted with a liner 175. The liner may be composed of any suitable material which is impermeable to water and/or other liquids. In a preferred aspect of the invention, the liner will be made of any suitable plastic material. If present, a liner will preferably, tightly fit within the enclosure define by the side walls, end walls, and base as shown in FIG. 19.

The dimensions of the container are not of particular importance, however, by way of example only, the container can be 50 to 70 inches high by 50 to 70 inches deep by 80 to 120 inches wide in an erected state, while it can be as little as 10 to 30 inches high in a collapsed state.

The capacity of the container is not of particular importance, however, by way of example only, the container can have a capacity of from 3 to 8 cubic yards.

It will recognized by persons skilled in the art, that the above description represents only specific embodiments, and that various modifications can be made without diverging from the scope of the invention described.

What is claimed is:

1. A collapsible container comprising:

a base comprising spaced apart top and bottom surfaces joined by a pair of base end walls and a pair of base side walls, a pair of integral end walls, and a pair of removable side walls;

wherein, said end walls are pivotally attached to said base;

a lower offset edge of said side walls reversibly and directly engages a groove in a top peripheral surface of said base by a tongue and groove interaction, said groove in said top peripheral surface of said base extending along the entire length of said base side wall;

said end walls and said side walls reversibly and directly engage one another along adjacent edges by a tongue and groove interaction;

said end walls and said side walls are a twinned wall structure defined by inner and outer wall members made of plastic; and each of said side walls comprises two side wall panels pivotally attached to one another along a vertical axis, the vertical axis being substantially perpendicular to said base, when the container is in an erect condition; and wherein at least one of said side walls and said end walls has a plurality of elongated concave indentations, each concave indentation independently forming a substantially vertical internal arch between said inner and outer wall members, said arch being arcuately shaped and spanning the length of said concave indentation.

2. The container of claim 1, wherein said end walls are pivotally attached to end retaining walls extending upwardly from said base.

3. The container of claim 2, wherein said end walls, said end retaining walls and said side walls have, along one lateral edge, a perpendicular corner extension; wherein said corner extension on said end walls and said end retaining walls reversibly engages an adjacent edge of said side walls by a direct tongue and groove interaction, and wherein said corner extension on said side walls reversibly engages an adjacent edge of said end walls by a direct tongue and groove interaction.

4. The container of claim 1 or claim 3, wherein a slide lock is present on one or both of said side walls, said slide lock comprising a partially tubular member riding along a track present in common upper edges of adjacent side wall panels and having a locked and unlocked position; wherein in said locked position, said partially tubular member prevents the folding of a side wall along said vertical axis by traversing said vertical axis; wherein in said unlocked position, said partially tubular member allows the folding of a side wall along said vertical axis by residing within a portion of the track which is entirely within one or the other side wall panels.

5. The container of claim 3, wherein said base has forklift tine pockets.

6. The container of claim 3, additionally comprising a liner.

7. The container of claim 3, additionally comprising a lid.

8. The container of claim 3, additionally comprising a canvass top.

9. The container of claim 1 or 3, wherein said ends walls and side walls are held to one another along said adjacent edges with a fastening means.

10. The container of claim 1, wherein said side walls and said end walls are rotomolded plastic components.

11. A collapsible container comprising:

a base comprising spaced apart top and bottom surfaces joined by a pair of base end walls and a pair of base side walls, a pair of integral end walls, and a pair of removable side walls;

wherein, said end walls are pivotally attached to said base;

a lower offset edge of said side walls reversibly and directly engages a groove in a top peripheral surface of said base by a tongue and groove interaction, said groove in said top peripheral surface of said base extending along the entire length of said base side wall;

said end walls and said side walls reversibly and directly engage one another along adjacent edges by a tongue and groove interaction;

said end walls and said side walls are a twinned wall structure defined by inner and outer wall members made of plastic; and each of said side walls comprises two side wall panels pivotally attached to one another along a vertical axis, the vertical axis being substantially perpendicular to said base, when the container is in an erect condition;

wherein a slide lock is present on one or both of said side walls, said slide lock comprising a partially tubular member riding along a track present in common upper edges of adjacent side wall panels and having a locked and unlocked position; wherein in said locked position, said partially tubular member prevents the folding of a side wall along said vertical axis by traversing said vertical axis; wherein in said unlocked position, said partially tubular member allows the folding of a side wall along said vertical axis by residing within a portion of the track which is entirely within one or the other side wall panels;

and wherein at least one of said side walls and said end walls has a plurality of elongated concave indentations, each concave indentation independently forming a substantially vertical internal arch between said inner and outer wall members, said arch being arcuately shaped and spanning the length of said concave indentation.

* * * * *